US010315236B2

(12) United States Patent
Bertness et al.

(10) Patent No.: US 10,315,236 B2
(45) Date of Patent: Jun. 11, 2019

(54) SYSTEMS AND METHODS OF FOOD DISPENSER CLEANING

(71) Applicant: Cornelius, Inc., Osseo, MN (US)

(72) Inventors: Elizabeth Bertness, Batavia, IL (US); Nancy Fortunato, Wauconda, IL (US); Loren Veltrop, Chicago, IL (US); Eric Larson, Pecatonica, IL (US); Hansel Sjukur, Lisle, IL (US)

(73) Assignee: Cornelius, Inc., Osseo, MN (US)

( * ) Notice: Subject to any disclaimer, the term of this patent is extended or adjusted under 35 U.S.C. 154(b) by 0 days.

(21) Appl. No.: 15/792,297

(22) Filed: Oct. 24, 2017

(65) Prior Publication Data

US 2018/0111173 A1 Apr. 26, 2018

Related U.S. Application Data

(60) Provisional application No. 62/412,576, filed on Oct. 25, 2016.

(51) Int. Cl.
*B08B 9/032* (2006.01)
*B67D 1/07* (2006.01)

(52) U.S. Cl.
CPC ..... *B08B 9/0325* (2013.01); *B08B 9/032* (2013.01); *B67D 1/07* (2013.01)

(58) Field of Classification Search
CPC ..... B08B 9/0325; B08B 9/032; B67D 1/07
USPC ..... 222/148, 1, 52, 63, 129.1, 149, 251
See application file for complete search history.

(56) References Cited

U.S. PATENT DOCUMENTS

| | | | | |
|---|---|---|---|---|
| 2,537,119 | A | 1/1951 | Buerlein et al. | |
| 3,460,717 | A | 8/1969 | Thomas | |
| 3,575,352 | A | 4/1971 | Hall et al. | |
| 4,218,014 | A | 8/1980 | Tracy | |
| 4,477,003 | A * | 10/1984 | Baker | B67D 7/02 222/144.5 |
| 4,635,825 | A | 1/1987 | Tulasne | |
| 4,708,266 | A | 11/1987 | Rudick | |
| 4,753,370 | A | 6/1988 | Rudick | |
| 4,792,402 | A | 12/1988 | Fricker | |
| 4,928,854 | A | 5/1990 | McCann et al. | |
| 4,967,932 | A | 11/1990 | Wiley et al. | |
| 5,025,840 | A | 6/1991 | Tacke | |
| 5,033,651 | A | 7/1991 | Whigham et al. | |
| 5,102,016 | A | 4/1992 | Ball et al. | |

(Continued)

FOREIGN PATENT DOCUMENTS

| | | |
|---|---|---|
| GB | 2042351 | 9/1980 |
| GB | 2340415 | 2/2000 |

(Continued)

*Primary Examiner* — Lien M Ngo
(74) *Attorney, Agent, or Firm* — Andrus Intellectual Property Law, LLP

(57) ABSTRACT

A cleaning system for a food substance dispenser includes a first cleaning solution reservoir configured to contain a first cleaning solution. A second cleaning solution reservoir is configured to contain a second cleaning solution. At least one pump is fluidly connected to the first and second cleaning solution reservoir and to at least one flexible tube of the dispenser. A controller is communicatively connected to the at least one pump and operates the pump to selectively circulate the first cleaning solution and the second cleaning solution through the flexible tubing of the dispenser.

20 Claims, 15 Drawing Sheets

(56) References Cited

U.S. PATENT DOCUMENTS 5,203,474 A 4/1993 Haynes
5,308,631 A 5/1994 Anglerot
5,332,311 A * 7/1994 Volk, Jr. ..... B01F 3/088 222/148
5,366,117 A 11/1994 Mesenbring et al.
5,415,326 A 5/1995 Durham et al.
5,429,681 A * 7/1995 Mesenbring ..... B67D 1/103 118/16
5,435,466 A 7/1995 Du
5,549,222 A 8/1996 Schroeder
5,566,863 A 10/1996 Mesenbring et al.
5,570,822 A 11/1996 Lemarbe et al.
5,649,644 A 7/1997 Hashimoto et al.
5,799,832 A 9/1998 Mayo
6,003,733 A 12/1999 Wheeler
6,016,935 A 1/2000 Huegerich et al.
6,047,859 A 4/2000 Schroeder et al.
6,095,371 A 8/2000 Mooney
6,189,736 B1 2/2001 Phallen et al.
6,220,047 B1 4/2001 Vogel et al.
6,227,420 B1 5/2001 Jepson
6,253,963 B1 7/2001 Tachibana
6,328,229 B1 12/2001 Duronio et al.
6,345,729 B1 2/2002 Santy
6,357,632 B1 3/2002 Salmela
6,390,662 B1 5/2002 Henry et al.
6,481,645 B1 11/2002 Taylor-McCune et al.
6,689,410 B2 2/2004 Gerber
6,698,229 B2 3/2004 Renken et al.
6,719,175 B2 4/2004 MacKenzie et al.
6,722,530 B1 4/2004 King et al.
6,739,524 B2 5/2004 Taylor-McCune et al.
6,745,592 B1 6/2004 Edrington et al.
6,871,761 B2 3/2005 Fox
7,059,761 B2 6/2006 Gerber
7,121,287 B2 * 10/2006 Carhuff ..... B08B 9/0321 134/169 R
7,159,743 B2 1/2007 Brandt et al.
7,243,818 B2 7/2007 Jones
7,337,920 B2 3/2008 Duck et al.
7,445,133 B2 11/2008 Ludovissie et al.
7,487,887 B2 2/2009 Ziesel
7,559,346 B2 * 7/2009 Herrick ..... A23C 9/133 141/102
7,717,297 B2 5/2010 Kadyk et al.
7,757,896 B2 7/2010 Carpenter et al.
7,878,370 B2 2/2011 Sevcik et al.
7,997,448 B1 8/2011 Leyva
8,091,737 B2 1/2012 Smeller et al.
8,113,386 B2 2/2012 Herrick et al.
8,167,173 B1 5/2012 Simmonds et al.
8,245,629 B2 8/2012 Little
8,322,570 B2 12/2012 Beavis et al.
8,490,829 B2 7/2013 Deo et al.
8,561,841 B2 10/2013 Erman et al.
8,584,900 B2 11/2013 Metropulos et al.
8,622,257 B2 1/2014 Erman et al.
8,631,974 B2 2/2014 Piatnik et al.
8,798,799 B2 8/2014 Deo et al.
8,839,989 B2 11/2014 Olson et al.
8,893,927 B2 11/2014 Olson et al.
8,899,280 B2 12/2014 Deo et al.
9,026,245 B2 5/2015 Tilton et al.
RE46,143 E 9/2016 Erman et al.
9,622,615 B2 4/2017 Hecht et al.
2002/0083730 A1 7/2002 Giroux et al.
2003/0161923 A1 8/2003 Holland et al.
2004/0118291 A1 * 6/2004 Carhuff ..... A47J 31/401 99/275
2004/0159676 A1 8/2004 Adema
2005/0051577 A1 3/2005 Loeb et al.
2005/0067433 A1 3/2005 Brandt et al.
2006/0157504 A1 7/2006 Barker et al.
2006/0175352 A1 * 8/2006 Emmendorfer ..... B08B 9/0325 222/148
2006/0196886 A1 9/2006 Fox
2008/0041876 A1 2/2008 Frank et al.
2008/0073376 A1 3/2008 Gist et al.
2008/0083780 A1 4/2008 Romanyszyn et al.
2008/0314918 A1 12/2008 Nuriely
2009/0014464 A1 * 1/2009 Adbelmoteleb ..... B08B 9/032 222/1
2009/0095771 A1 4/2009 Hoover
2009/0120958 A1 5/2009 Landers et al.
2009/0230149 A1 9/2009 Smeller et al.
2010/0147875 A1 6/2010 Santos et al.
2010/0176147 A1 * 7/2010 Segers ..... B67D 1/07 222/1
2011/0264285 A1 10/2011 Mattos et al.
2012/0126034 A1 5/2012 Nolen et al.
2012/0285329 A1 11/2012 Verhoeven et al.
2013/0096715 A1 4/2013 Chung et al.
2013/0104743 A1 * 5/2013 Deo ..... A47J 31/60 99/275
2013/0177261 A1 7/2013 Bushnaw
2013/0200103 A1 8/2013 Gates
2013/0206793 A1 8/2013 Minica et al.
2013/0282169 A1 10/2013 Moore et al.
2014/0069953 A1 3/2014 Metropulos et al.
2014/0081777 A1 3/2014 Mastrodonato et al.
2014/0114469 A1 4/2014 Givens et al.
2014/0166053 A1 * 6/2014 Carson ..... B67D 1/07 134/22.11
2014/0263414 A1 9/2014 San Miguel et al.
2014/0372233 A1 12/2014 Knecht et al.
2015/0017297 A1 1/2015 Vastardis et al.
2016/0068383 A1 * 3/2016 Falco, III ..... B67D 1/0888 222/1
2016/0184846 A1 * 6/2016 Pellin ..... B05B 7/166 239/135
2016/0229675 A1 8/2016 Popov et al.
2016/0332176 A1 11/2016 Mastro et al.
2017/0119199 A1 5/2017 Williston et al.
2017/0122444 A1 5/2017 Wilson et al.
2017/0122449 A1 5/2017 Wilson et al.
2017/0122450 A1 5/2017 Wilson et al.
2017/0122451 A1 5/2017 Wilson et al.
2017/0123509 A1 5/2017 Erman et al.
2017/0190554 A1 7/2017 Dahlberg et al.

FOREIGN PATENT DOCUMENTS

WO 9927070 6/1999
WO 2007087611 8/2007
WO 2012135917 10/2012
WO 2014062915 4/2014
WO 2014151946 9/2014

* cited by examiner

SYSTEMS AND METHODS OF FOOD DISPENSER CLEANING

CROSS-REFERENCE TO RELATED APPLICATION

The present application claims priority of U.S. Provisional Patent Application No. 62/412,576, filed on Oct. 25, 2016, the content of which is hereby incorporated herein by reference in its entirety.

BACKGROUND

As restaurants, concessions, and vending services move towards increased customized product offerings and consumers look for a more personalized food experience, vendors are looking for new ways to incorporate these trends. A dispenser of custom flavored condiments is thus desirable in the field.

Automation and customization of dispensing systems come at an increased complexity. A challenge to complex systems that contact substances for consumption, is maintaining cleaning and sanitation standards. Overly burdensome cleaning processes can require specialized technicians and increased cost of ownership of a device. Therefore, solutions are needed for improved cleaning of automated dispensers of edible substances.

BRIEF DISCLOSURE

In an exemplary embodiment of a cleaning system for a food substance dispenser, a first cleaning solution reservoir is configured to contain a first cleaning solution. A second cleaning solution reservoir is configured to contain a second cleaning solution. At least one pump is fluidly connected to the first and second cleaning solution reservoirs. At least one interface is configured to fluidly connect the at least one pump to a flexible tube of the dispenser. A controller is communicatively connected to the at least one pump. The controller operates the at least one pump to selectively circulate the first cleaning solution from the first cleaning solution reservoir through the flexible tubing of the dispenser. The controller then operates the at least one pump to selectively circulate the second cleaning solution from the second cleaning solution reservoir through the flexible tubing of the dispenser.

In an exemplary embodiment of a self-cleaning food substance dispenser, at least one dispense reservoir is configured to hold a food substance. At least one nozzle is configured to dispense the food substance. At least one flexible tube fluidly connects the at least one dispenser reservoir to the at least one nozzle. A first cleaning solution reservoir is fluidly connected to the at least one flexible tube. The first cleaning solution reservoir is configured to contain a first cleaning solution. A second cleaning solution reservoir is fluidly connected to the at least one flexible tube. The second cleaning solution reservoir is configured to contain a second cleaning solution. At least one pump is arranged to create a pressure within the flexible tube. A controller is communicatively connected to the at least one pump. The controller provides operational instructions to the at least one pump to dispense the food substance from the at least one dispense reservoir. The controller provides operational instructions to the at least one pump to selectively circulate the first cleaning solution from the first cleaning solution reservoir through the at least one flexible tube. The controller provides operation instructions to the at least one pump to selectively circulate the second cleaning solution from the second cleaning solution reservoir through the at least one flexible tube.

DETAILED DISCLOSURE

Figure 1:
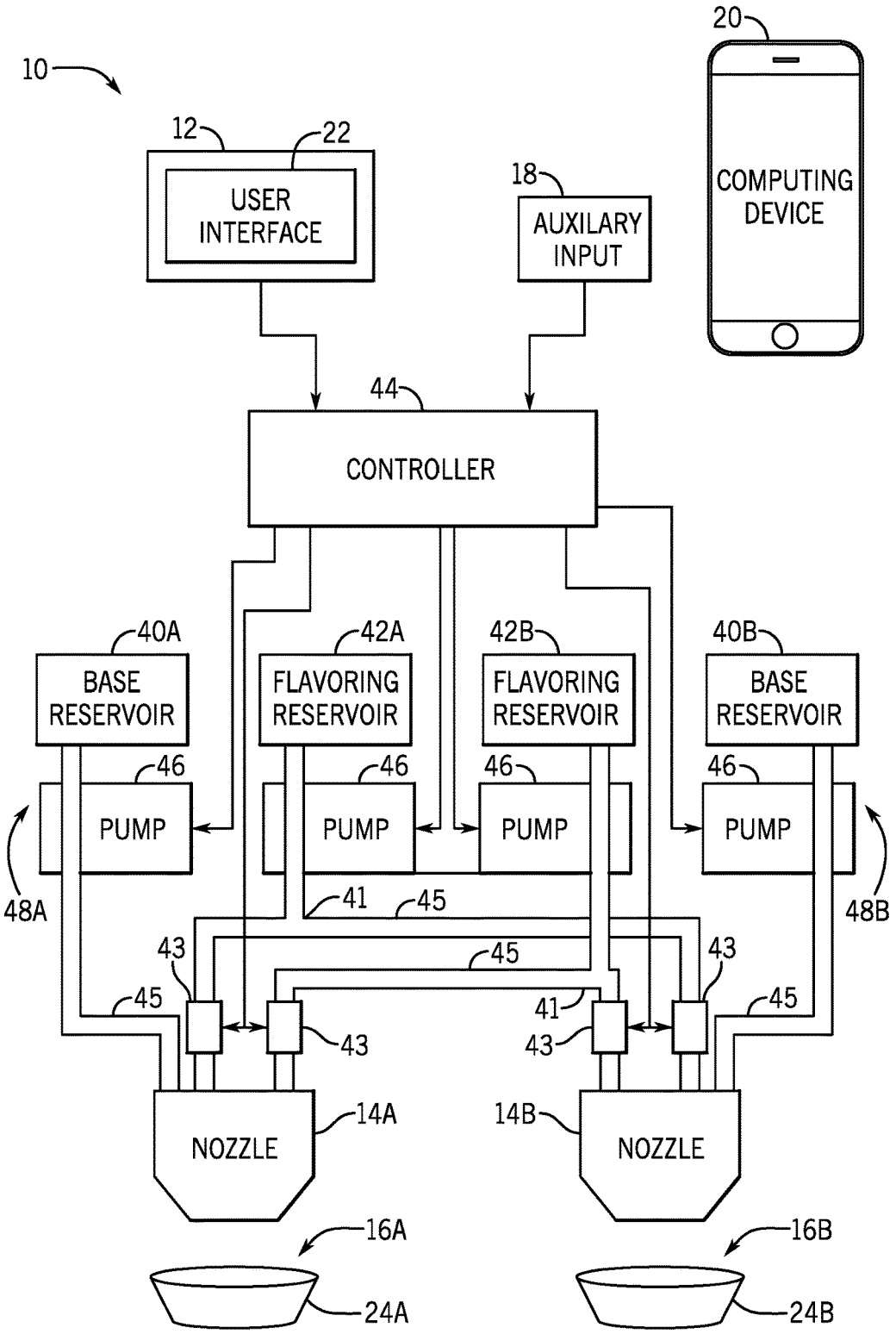
FIG. 1 is a system diagram that depicts an exemplary embodiment of a custom dispenser.

FIG. 1 depicts an exemplary embodiment of a dispenser 10. The dispenser 10 may exemplarily be configured to dispense condiments, custom flavored condiments, or custom flavorings as disclosed herein. The custom condiment dispenser 10 exemplarily includes a graphical display 12, which may also function as a user input device in exemplary embodiments of which will be described in further detail herein. The graphical display 12 is exemplarily a touch screen graphical display that is operable as a user interface, although it will be recognized that in other embodiments, other forms of user interfaces including but not limited to physical keyboards, gesture, as well as wireless embodiments including WI-FI and/or BLUETOOTH protocols for communication with a smart phone or other handheld wireless device may be used.

The dispenser 10 further includes at least one nozzle 14 through which the condiment, custom condiment, or flavoring is dispensed into a dispensing area 16 in which the user may place a receptacle 24 such as a portion cup, a food item, or a refillable bottle.

By way of example, the dispenser 10 in FIG. 1 is depicted and described herein as a customer condiment dispenser wherein a base conduit is mixed with one or more flavorings to produce a customer condiment. It will be recognized that other embodiments may be configured to dispenser base condiment or flavoring separately or to dispense a pre-mixed flavored condiment. In the custom condiment dispenser 10 of FIG. 1, each of the nozzles 14 receive a flow of a base condiment and a flow of at least one flavoring out of a plurality of potential flows of flavorings. In exemplary embodiments the base condiment and the at least one flavoring can mix at various stages in the dispenser, for example, in the nozzle 14, as the base condiment and at least one flavoring exit the nozzle, and/or after the base condiment and at least one flavoring are received within a receptacle. It will be recognized that as used herein "mixing" need not result in a homogenous mixture between the base condiment and the at least one flavoring and that a custom condiment may be "mixed" without being uniform in distribution of constituent component or uniform in color.

Embodiments of the custom condiment dispenser 10 may operate in a variety of ways to dispense various types of custom condiments while remaining within the scope of the present disclosure. In an exemplary embodiment, the custom condiment dispenser 10 may include base condiment reservoirs 40, for example, but not limited to reservoirs 40 for ketchup, barbeque sauce, ranch dressing, and/or mayonnaise. The custom condiment dispenser 10 includes flavoring reservoirs 42. As will be described in further detail herein, the flavorings contained within the flavoring reservoirs 42 and used by the condiment dispenser 10 may take a variety of forms including, but not limited to liquid concentrated flavoring or a concentrated flavoring sauce. It is understood that the flavoring reservoirs 42 may be adapted to contain and dispense a particular type of flavoring. Upon user operation of the user interface presented on the graphical display 12 to select a custom condiment to dispense, a controller 44 operates the custom condiment dispenser 10 to dispense the combination of the base condiment and at least one of the appropriately selected flavorings to produce the selected custom condiment. Upon selection by user, the custom condiment dispenser 10 operates to dispense a portion of the selected condiment from the appropriate receptacle(s) through one or more nozzles 14.

The condiment dispenser 10 may include one or more base condiment reservoirs 40 and one or more flavoring reservoirs 42. Each of the reservoirs 40, 42 are exemplarily connected to pumps 46 which pump the base condiments and at least one flavoring to the nozzle 14. In an exemplary embodiment a flexible tube 45 may connect each of the reservoirs 40, 42 to at least one of the pumps 46. In exemplary embodiments, the pumps 46 are peristaltic pumps that operate to respectively push the base condiment and flavoring through the respective flexible tubes 45. The flexible tubes 45 exemplarily extend through the pumps 46 and prevent the pumps 46 from being in contact with the food (e.g. the base condiment or flavoring) flowing through the flexible tubes 45. In embodiments, the flexible tubes convey the base condiments and flavorings from a respective reservoir to the nozzle during dispense while isolating the base condiments and flavorings from many of the mechanical components of the condiment dispenser 10. For example, by using peristaltic pumps and pinch valves, both the pump and the valves can operate on the flexible tube, while the tube retains the base condiments and flavorings from contacting these components.

In an embodiment, the flexible tubes 45 from each reservoir 40, 42 are each directed through a different pump 46. In an exemplary embodiment, each base condiment is arranged in a dispensing system 48 associated with a single nozzle 14. The flexible tubes 45 carrying flavoring are directed to each of the nozzles. The flexible tubes 45 carrying flavoring may include a T-connection 41, which may be another type of connection exemplarily depending upon the number of nozzles 14 in the dispenser 10. Valves 43 are disposed in or along each of the flexible tubes 45 carrying flavoring prior to the nozzle 14. The valves 43 may exemplarily be, but are not limited to pinch valves.

A first dispensing system 48A includes condiment reservoir 40A and nozzle 14A, while a second dispensing system 48B includes condiment reservoir 40B and nozzle 14B. It will be understood that in other embodiments more or fewer than two dispensing systems may be used in a condiment dispenser 10. In a non-limiting embodiment, base reservoir 40A is filled with ketchup and condiment reservoir 40B is filled with ranch dressing. In other exemplary and non-limiting embodiments, barbeque sauce and/or mayonnaise may be the base condiments. Flavoring reservoirs 42A and 42B are exemplarily filled with flavorings of different flavors and are each connected to both the first dispensing system 48A and the second dispensing system 48B. It will be noted that in an embodiment, two base condiment reservoirs 40 may be connected, exemplarily with a Y-connector 47, to provide additional reservoir capacity for a specific type of base condiment. For example, if ketchup condiment is used in a greater amount, then two or more reservoirs of ketchup may be simultaneously connected to the ketchup dispensing system. In a still further embodiment, the entire condiment dispenser may be configured to only dispense custom ketchups and all of the base condiment reservoirs 40 are connected together with flexible tubing directed through a single pump. While FIG. 1 depicts the base condiment and/or flavoring dispensed by electromechanical pumps, it will be recognized that other embodiments may use gravity feed, pressurization within the reservoirs or other dispensing techniques. The base condiment and flavoring may mix in a manifold, mix in the nozzle, or dispense into a container separately for later mixing.

While the reservoirs depicted in FIG. 1 are depicted as refillable and reusable containers, it will be recognized that other embodiments may use any of a wide variety of reservoirs. Alternative examples of reservoirs may include, but are not limited to, disposable packaging such as bags, boxes, and bag-in-box packaging. Still further examples of reservoirs may include movable or removable lids to facilitate refilling of reservoirs with additional base condiment or flavoring. In still further examples, the reservoirs may be fillable through an opening with a removable cap, for example a removable cap which facilitates connection of the reservoir to the condiment dispenser. The connections between the reservoirs 40, 42 and the flexible tubes 45 may comprise a two-part connector with ends secured to the flexible tubes 45 designed to mate with a cap or cover of a reservoir to provide a secure connection. In a still further embodiment, particular flexible tubes 45 and reservoirs 42 may be keyed such that the flexible tubes 45 are reconnected only to an associated reservoir such as to avoid cross-contamination of the flavorings, or to ensure that each flavoring line in the custom condiment dispenser carries the expected flavoring.

In the present disclosure, it will be recognized by a person of ordinary skill in the art that condiments, including, but not limited to ketchup, mayonnaise, mustard, liquid butter, olive oil, liquid cheese sauce, yogurt, ranch, guacamole, sour cream, chili, and/or tartar sauce may be the base condiments. In addition to the above savory foods, sweet foods for example sauces, syrups, and other toppings for example chocolate, butterscotch, caramel, and strawberry may be dispensed in other embodiments.

In non-limiting examples, flavors such as sriracha, buffalo, jalapeno, teriyaki, honey, onion, garlic, bacon, oak, soy sauce, smoke, pepper, vinegar, pickle, chili, mint, basil, vanilla, chocolate, caramel, and/or wasabi may be used although it will be recognized that these examples of flavorings are again merely exemplary of possible flavors and are not intended to be limiting on the scope of flavors that may be provided in a custom condiment dispenser in either of liquid or flavored sauce form. While guacamole and tarter were exemplarily identified above as examples of base condiments, it may also be recognized that those sauces may exemplarily be produced as custom condiments when other base sauces are used in combination with further examples of flavorings. For example in the case of guacamole, a base condiment of sour cream may be combined with avocado and onion and/or jalapeño to produce guacamole. While tarter sauce may be produced by a combination of a base condiment of mayonnaise with onion and pickle relish flavorings.

As previously noted, the flavorings may come in a variety of forms. In one exemplary embodiment, the flavorings are a concentrated liquid flavoring. Such concentrated liquid flavorings may be exemplarily water, alcohol, or oil based and potentially highly concentrated and therefore may require volumetrically a small amount of the flavoring to achieve the custom condiment. In such embodiments, the flavoring reservoirs and associated pumps may be comparatively small to handle these volumes. In another embodiment, the flavoring may be in the form of a flavored sauce. Exemplarily, the flavored sauce may be a liquid starch sauce that carries the flavoring. This increases the volume of the flavoring which can promote mixing of the custom condiments in embodiments as disclosed in further detail herein. In further exemplary embodiments, the carrier sauce may be mixed with varying concentrations of the flavoring to produce different intensities of flavor for custom condiments further as described herein.

User interaction with the GUI 22 inputs commands to the controller 44. In an embodiment, upon user selection of a dispense button or input, the custom condiment dispenser 10 operates to dispense the selected custom condiment in the manners as presently disclosed. In embodiments, the timing and control of the dispense can be carried out in a number of ways while remaining within the present disclosure. The dispenser may dispense a predetermined volume or a user selected volume. A single interaction with the dispense button may initiate dispense of the entire defined volume. In another embodiment, the dispenser may dispense as long as the user continues to touch or otherwise engage the dispense button 32. This embodiment may be limited by a maximum dispense amount. In an example, the dispenser will dispense up to a predetermined full dispense volume which may exemplarily be a portion e.g. 1 oz, 1.5 oz, 2 oz, or 6 oz, although these are not intended to be limiting on the volume of such a maximum dispense amount. Such an embodiment allows the user to control the precise volume dispensed by stopping dispense at the user's discretion, while also limiting excessive dispense and waste of condiment. In embodiments wherein only flavoring is dispensed, the volumes may be significantly smaller, including 1 mL-10 mL or less.

One challenge to laminar mixing of foods is that while increased surface area of the interface between the base condiment and the flavorings enhances the shear mixing effect during the laminar flow, increased physical surfaces in the nozzle and increased complexity of the nozzle geometry can create spaces which are challenging to clean and keep clean making such geometries impractical for use in food processing. Still further challenges addressed by the nozzle 14 are that shear mixing occurs upon interaction of the substances in a laminar flow however; currently available geometries for nozzles to create such laminar flow do so at a high pressure drop. This high pressure drop and the resulting increase velocity causes shear thinning among many base condiments which are often fluid or semisolid foods which rheologically act as pseudo plastics or non-Newtonian fluids. Shear thinning while increasing mixing can degrade the consumer perceived quality of condiments and mouth feel of condiments. Therefore, geometries of nozzles may be used to exhibit a low pressure drop to maintain condiment quality. Additionally, due to the viscosity of the condiments, the practically achieved flow rates of the condiments may be low due to the qualities available pumps.

In exemplary embodiments, the pumps 46 may exemplarily be peristaltic pumps and the speed at which the pumps are operated may be either matched to the viscosity of the base condiment or flavoring to be moved by the pump or the speed of the pump may be controlled based upon the viscosity and/or temperature of the base condiment or flavoring to be dispensed.

Operation of the dispenser as described above places various components in direct contact with food. While the flexible tubes 45 and peristaltic pumps are used in embodiments to limit the number and complexity of components that are in direct contact with food, the reservoirs, flexible tubing, valves, and nozzle may all make direct contact with food and therefore must be cleaned in order to comply with exemplary NFS/ANSI standards for sanitation of food handling or processing equipment. Therefore, exemplary embodiments of the dispenser further require additional systems/processes as disclosed herein to clean the system in an efficient and effective manner to comply with sanitation standards.

Figure 2:
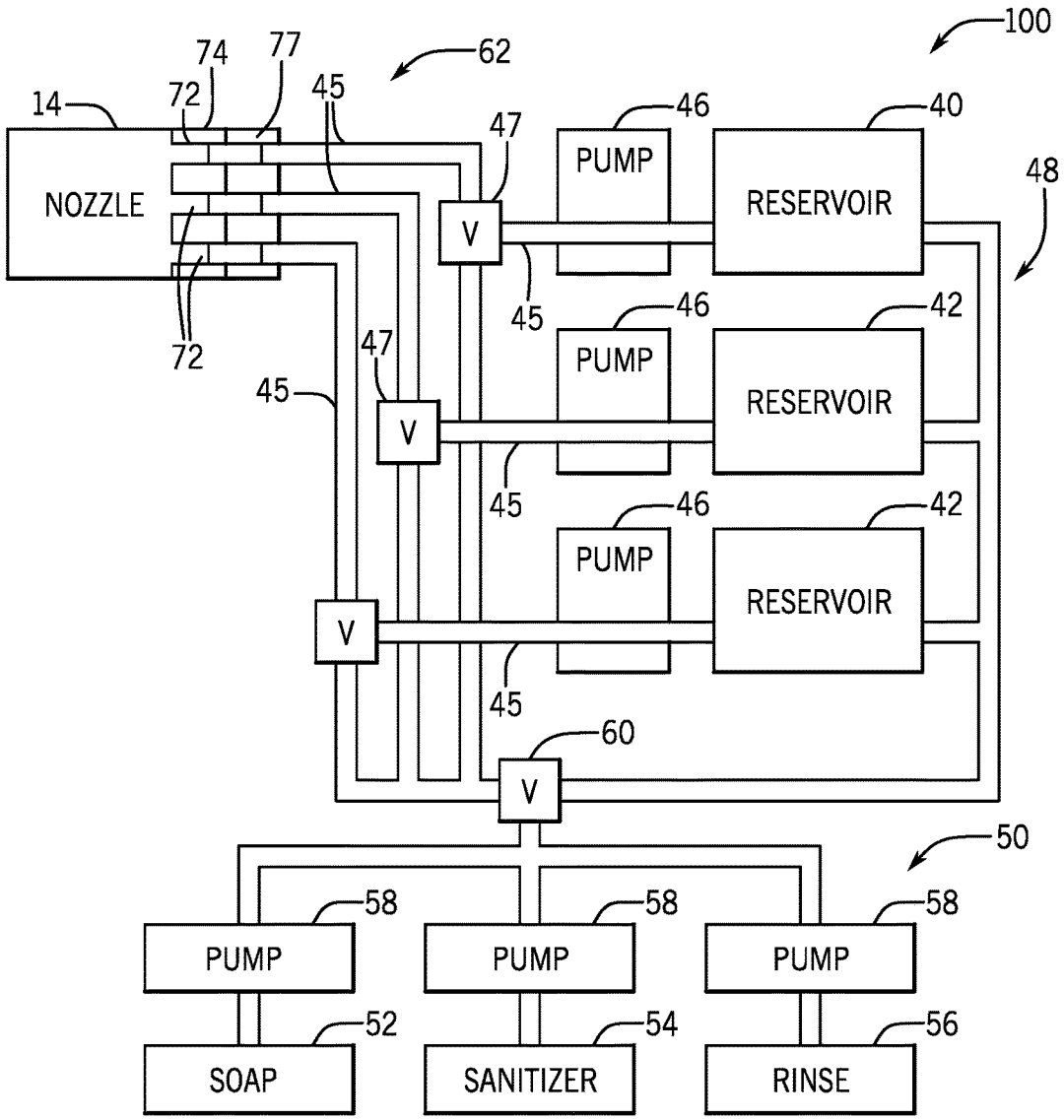
FIG. 2 is a system diagram of an embodiment of a dispenser cleaning system.
Figure 3:
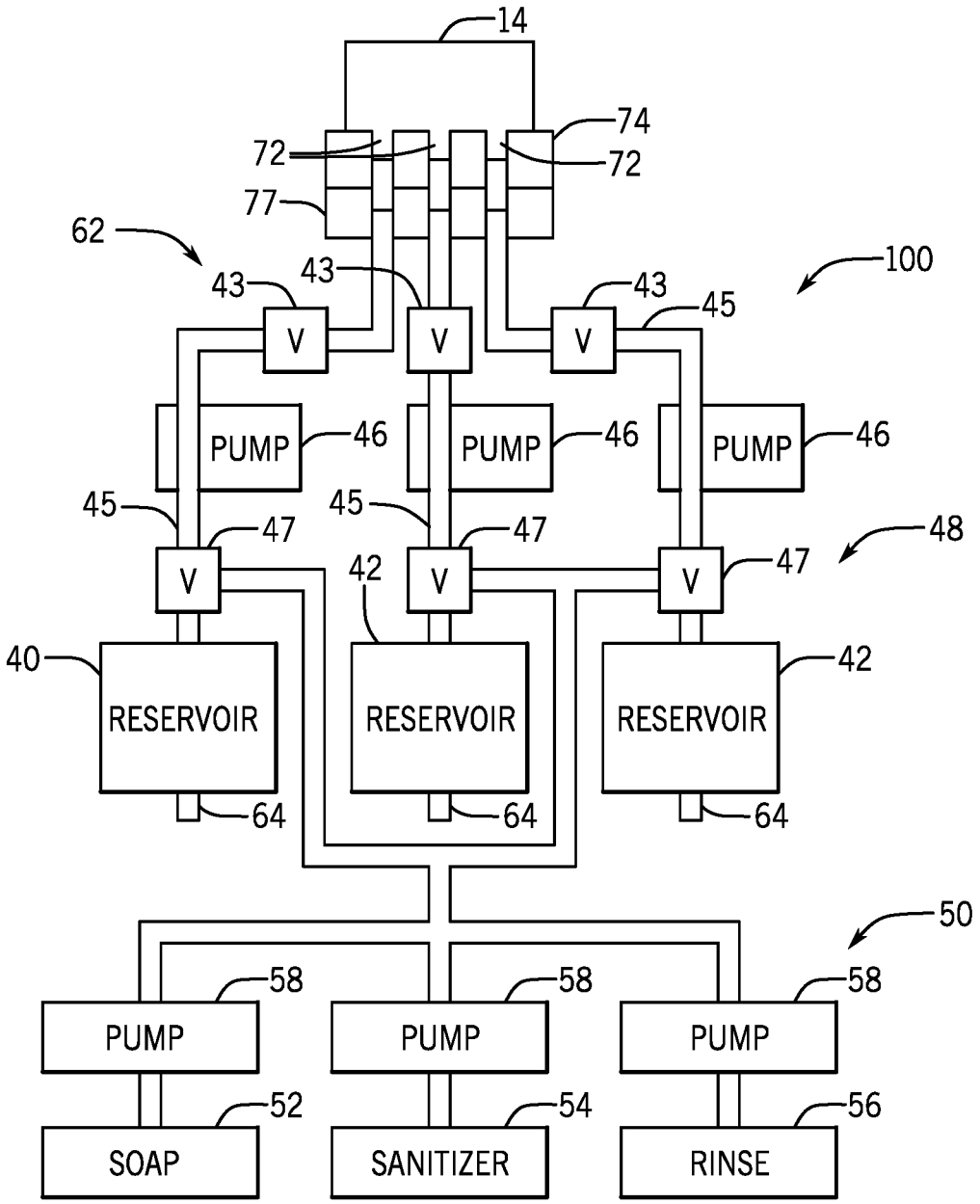
FIG. 3 is a system diagram of another embodiment of a dispenser cleaning system.

FIGS. 2 and 3 depict system diagrams of exemplary embodiments of dispensers 100 with cleaning systems 50. It will be recognized that these cleaning systems are merely exemplary and that other configurations of cleaning systems may be used while remaining within the scope of the present disclosure. Still further embodiments within the present disclosure may include a combination of features shown and described respectively with FIG. 2, 3, or any of the other figures shown and described herein. In an exemplary embodiment, all or a portion of the cleaning system 50 may be integrated into a dispenser 100 and will be recognized that similar reference numbers may be used between the Figures to identify the same or similar structures between the embodiments.

Dispenser 100 exemplarily includes a dispensing system 48 as described above with respect to FIG. 1, and additionally incorporates a cleaning system 50. In an exemplary embodiment, the cleaning system 50 may be an integrated part of the dispenser 100. However, it will be recognized that in other embodiments the cleaning system 50 may be a separate device connectable to the dispensing system 48. In still further embodiments, an internal cleaning system 50 is operated in connection with a cleaning device (not depicted) described in further detail with respect to other embodiments herein.

The cleaning system 50 exemplarily includes a plurality of cleaning solution reservoirs. This includes a detergent reservoir 52, a sanitizer reservoir 54, and a rinse reservoir 56. These reservoirs are each filled with an appropriate solution used during the cleaning process, with a detergent solution in the detergent reservoir 52, sanitizing solution in the sanitizer reservoir 54, and rinse solution in the rinse reservoir 56. Exemplarily, each of the detergent reservoir 52, sanitizer reservoir 54, and rinse reservoir 56 are connected to a pump 58. A valve 60 as depicted in FIG. 2 exemplarily controls connection of the cleaning system 50 to the dispensing system 48. In an exemplary embodiment, the valve 60 is a three-positioned valve which optionally closes the cleaning system 50 from connection to the dispensing system 48, connects the cleaning system 50 to the reservoirs 40, 42 of the cleaning system 48, or connects the cleaning system 50 to the flexible tubes 45 of the dispensing system 48. Three way valves 47 may further connect the cleaning solution lines 49 to the flexible tubes 45. An exemplary embodiment of a three way valve 47 is shown and described in further detail herein with respect to FIG. 16. In another embodiment, the three way valve 47 may instead be a T-connector. It will be recognized that the condiment dispenser 100 further includes the controller 44 as depicted and described with respect to FIG. 1 which is communicatively and operatively connected to the valves and pumps as depicted herein to control the flow of cleaning solutions through the dispensing system 48. In a still further embodiment, the valve 47 may be an electronically controlled valve that operates in accordance with control signals provided by the controller 44 (FIG. 1).

Optionally, the cleaning system 50 may be removably attached to the dispensing system, exemplarily at the valve 60. As described in further detail herein, in an embodiment, the valve 60 may operate to direct the cleaning solutions to and from the dispensing system 48 to perform an automated or semi-automated cleaning routine. For example, cleaning solution may be directed into the reservoirs 40, 42 and flushed through the dispensing system 48 out the nozzle 14. In another embodiment, the valves 47 and valve 60 may be operated to direct cleaning solution back into the respective reservoir 52, 54, 56 after it is used. The reservoirs filed with used fluid can then be removed and replaced at the convenience of a food service worker or technician. In still further exemplary embodiments, the valve 47 and valves 60 may be operated to recirculate cleaning solution through the reservoir 40, 42 and pumps 46 in one or more circuits to provide additional agitation and/or flushing of the system before directing the cleaning solutions out of the dispensing system 48. In this manner, the pumps 46 may be operated to circulate the cleaning solution through the flexible tubes 45 and the reservoirs 40,42 in either direction. In a still further exemplary embodiment, the valve 60 and the valve 43 may be operated to direct the cleaning solutions through the flexible tubes 45 and out of the nozzle 14.

Figure 16:
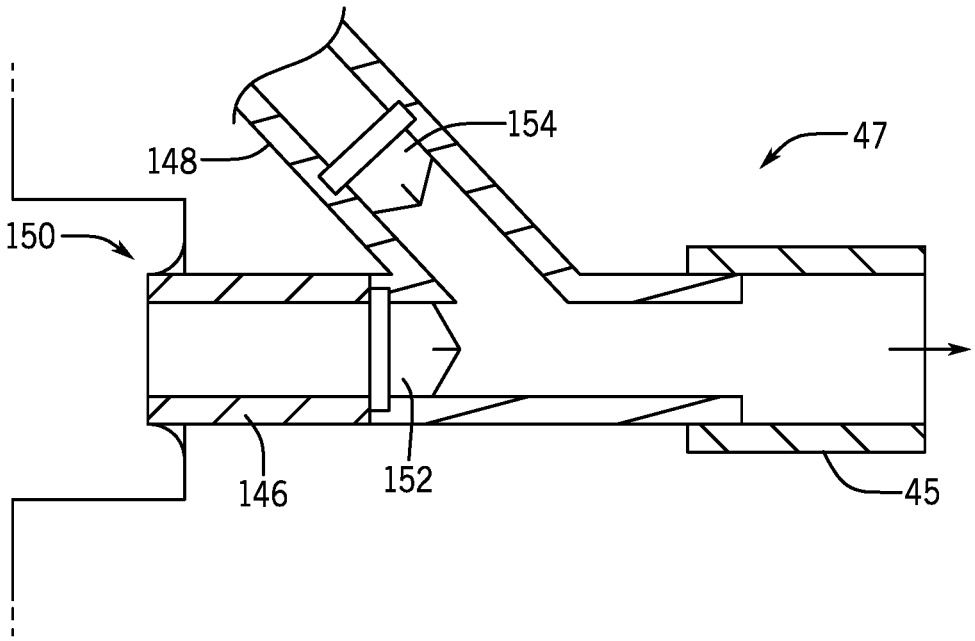
FIG. 16 depicts an exemplary embodiment of a three-way valve as may be used in embodiments of a dispenser cleaning system.

FIG. 3 depicts a similar dispenser 100 and cleaning system 50 as described above with respect to FIG. 2. However, it will be recognized that the cleaning system 50 is fluidly connected to the dispensing system 48 at the valves 47 and is otherwise not directly connected to the reservoirs 40, 42. In an exemplary embodiment, this arrangement may be used in similar manners as described above to exemplarily clean from the valves 47 through the flexible tube 45 to the nozzle 14 with the cleaning solutions. In a still further exemplary embodiment, the reservoirs 40, 42 may be detachable or removable for cleaning or replacement. In such an embodiment, the interface between the flexible tube 45 and the reservoir 40, 42 may be cleaned separately and a valve 47 such as depicted in FIG. 16 used to circulate the cleaning solutions through the dispenser with the reservoirs 40, 42 disconnected. Alternatively, the cleaning solutions may be provided through the valves 47 and the pumps 46 operate in reverse to push the cleaning solutions into the reservoirs 40, 42 to clean the reservoirs 40, 42 and the flexible tube 45 between the reservoirs 40, 42 and the valve 47.

In exemplary embodiments, the pumps 46 may operate in a series of cycles between forward and reverse operation in order to agitate one or more of the cleaning solutions in the reservoirs 40, 42 and/or in the flexible tubes 45. The agitation created by repeated forward and reverse flow cycles can provide an additional mechanical force for dislodging or otherwise removing food build-up. In another exemplary embodiment, the controller may operate the pumps to create a positive pressure in the flexible tubes 45, while also selectively closing and opening valves 43 to selectively dead head the flexible tubes 45 to build up pressure therein. Upon the controller operating the valves 43 to open, the built up pressure is released. This has been found to provide further mechanical action to facilitate cleaning of the flexible tubes 45, particularly when the cleaning solution(s) are at a cool or not heated temperature. In embodiments, the controller may operate the valves 43 through multiple cycles of closing and opening and in embodiments, the valves may be closed for a short time, for example a few seconds, while in other embodiments, the valves may be closed for a longer time. The flexibility of the flexible tubes 45 can resiliently deform to absorb the increased pressure without risk of damage to the system when dead headed. It will be recognized that in embodiments, both the operation of the valves and the forward and reverse operation of the pumps may be used in a cleaning operation.

After the reservoirs 40, 42 have been cleaned, the cleaning solution may be directed back into the respective cleaning solution reservoir 52, 54, 56, or the cleaning solutions may be directed out of the condiment dispenser 100 through the nozzle 14. In still further embodiments, the reservoirs 40, 42 may be provided with an axillary connection 64. The axillary connection 64 may be connected to a drain or sump to receive the used cleaning solutions. In an alternative embodiment, the cleaning solution provided in the cleaning system 50 may be provided to the valves 47 for cleaning the upper plumbing 62 between the valves 47 and the nozzle 14 which may be performed on a weekly basis. However, cleaning standards may require that a more complete cleaning of the entire dispensing system 48 occur at less frequent intervals, for example monthly. In such an embodiment, the axillary connections 64 of the reservoirs 40, 42 may be connected to an external source of cleaning solution which is pushed and/or drawn through the dispensing system 48 by an external pumping system to clean the dispensing system.

FIGS. 4-8 depict exemplary embodiments of a user operating various exemplary features as may be found in embodiments of cleaning systems and condiment dispensers as disclosed herein. It will be recognized that some embodiments may be more or fewer of the features as described herein with respect to FIGS. 4-8 while remaining within the scope of the present disclosure.

Figure 4A:
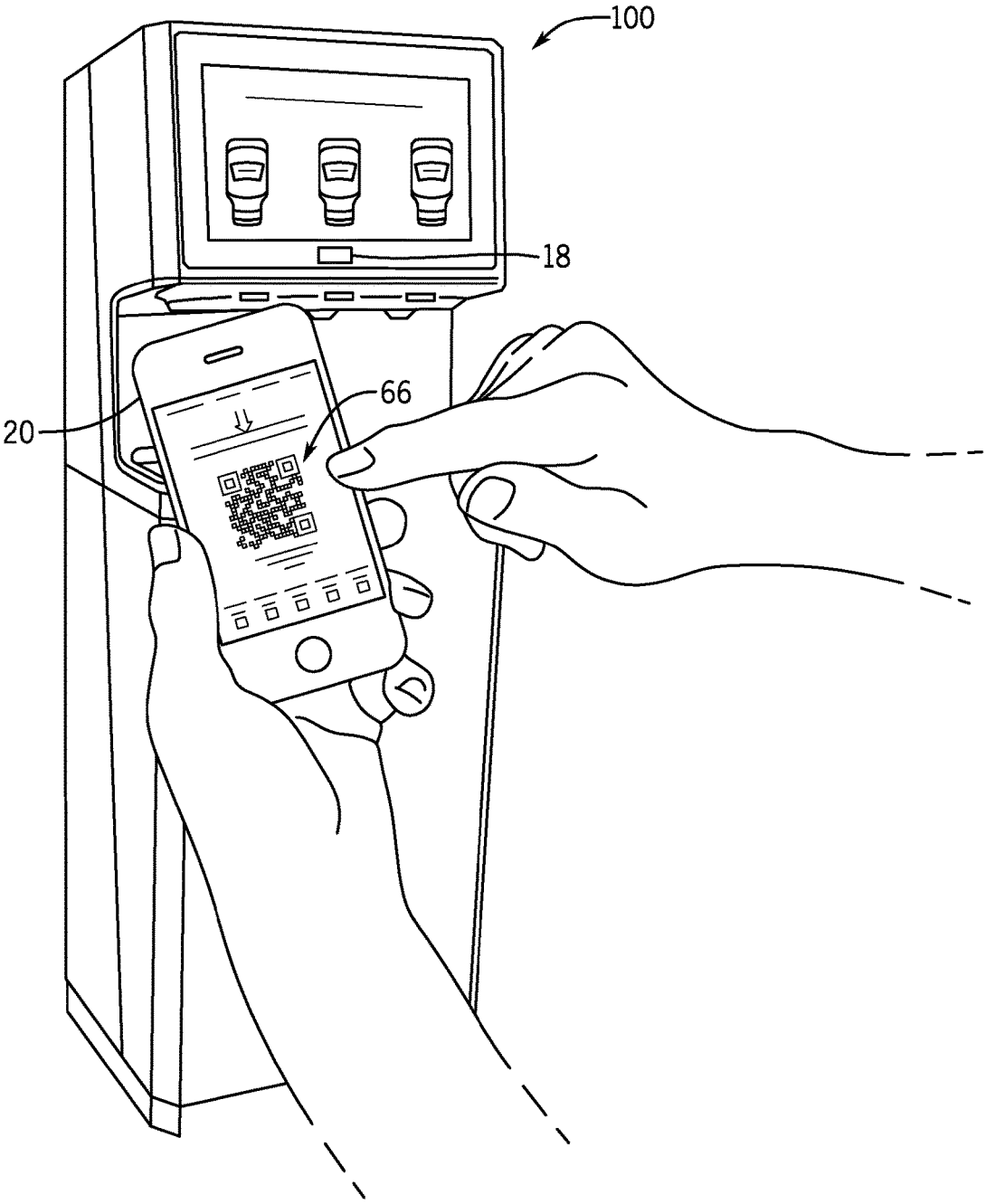
FIGS. 4A and 4B depict an exemplary embodiment of a user inputting a cleaning instruction.
Figure 4B:
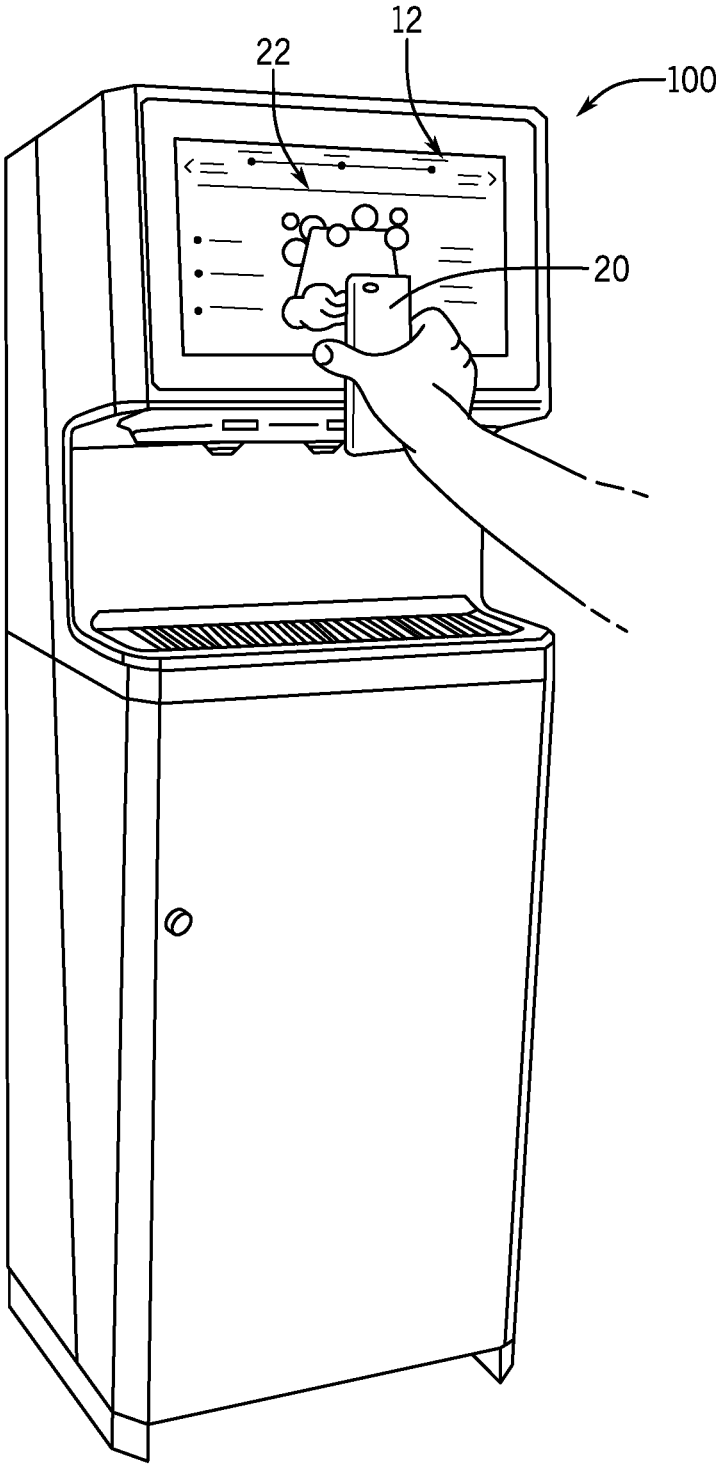

FIGS. 4A and 4B depict an exemplary embodiment of a user inputting a cleaning instruction into a condiment dispenser 100. In such an exemplary embodiment, the user uses a mobile device 20 to select a cleaning routine, instruction, or program from an available file, app, or website accessible through the mobile device 20. In a non-limiting embodiment, the mobile device 20 operates to visually present a bar code, exemplarily a quick response (QR) or other two dimensional bar code representative of the cleaning instruction, routine, or program. As previously described, the condiment dispenser 100 includes an axillary input device 18, which is exemplarily a bar code reader and more specifically in an embodiment a QR code reader. As depicted in FIG. 4B, the user holds the QR code presented on the mobile device 20 near the QR code reader 18 and the graphical display 12 is operated to present a graphical user interface (GUI) with controls for a cleaning operation. In an exemplary embodiment, the QR code 66 presented on the mobile device 20 unlocks and makes available the cleaning application GUI 22 which enables the user to select any of a plurality of predefined cleaning routines, for example a daily cleaning routine, a weekly cleaning routine, and a monthly cleaning routine. Alternatively, the QR code 66 may input to the condiment dispenser not only operation in a cleaning mode, but also input a request for a specific cleaning operation. In embodiments as will be described in further detail herein, once a cleaning operation is selected and input into the condiment dispenser, the condiment dispenser 100 through operation of the controller 44 can operate both the graphical display 12 to visually present instructions to the user, as well as carry out some or all of the requested cleaning routine automatedly by operating the valves and pumps as exemplarily previously described with respect to FIGS. 2 and 3.

In the case where cleaning procedures are required at specific intervals, the controller of the machine may operate a timer or clock that tracks the specific cleaning intervals and may further operate to lockout dispense of a product until the scheduled cleaning procedure is performed. The machine may provide a warning to the user visually on the screen, or remotely via a smartphone application or communication network integration to a management computer to complete the procedure within a specified time limit before dispense is locked out, requiring a service tech override. The cleaning interface may also contain other useful features such as a screen wipe down lockout, where the user engages a period of time where touching the screen does not perform any function, so the screen may be cleaned without inadvertent dispensing.

Figure 5:
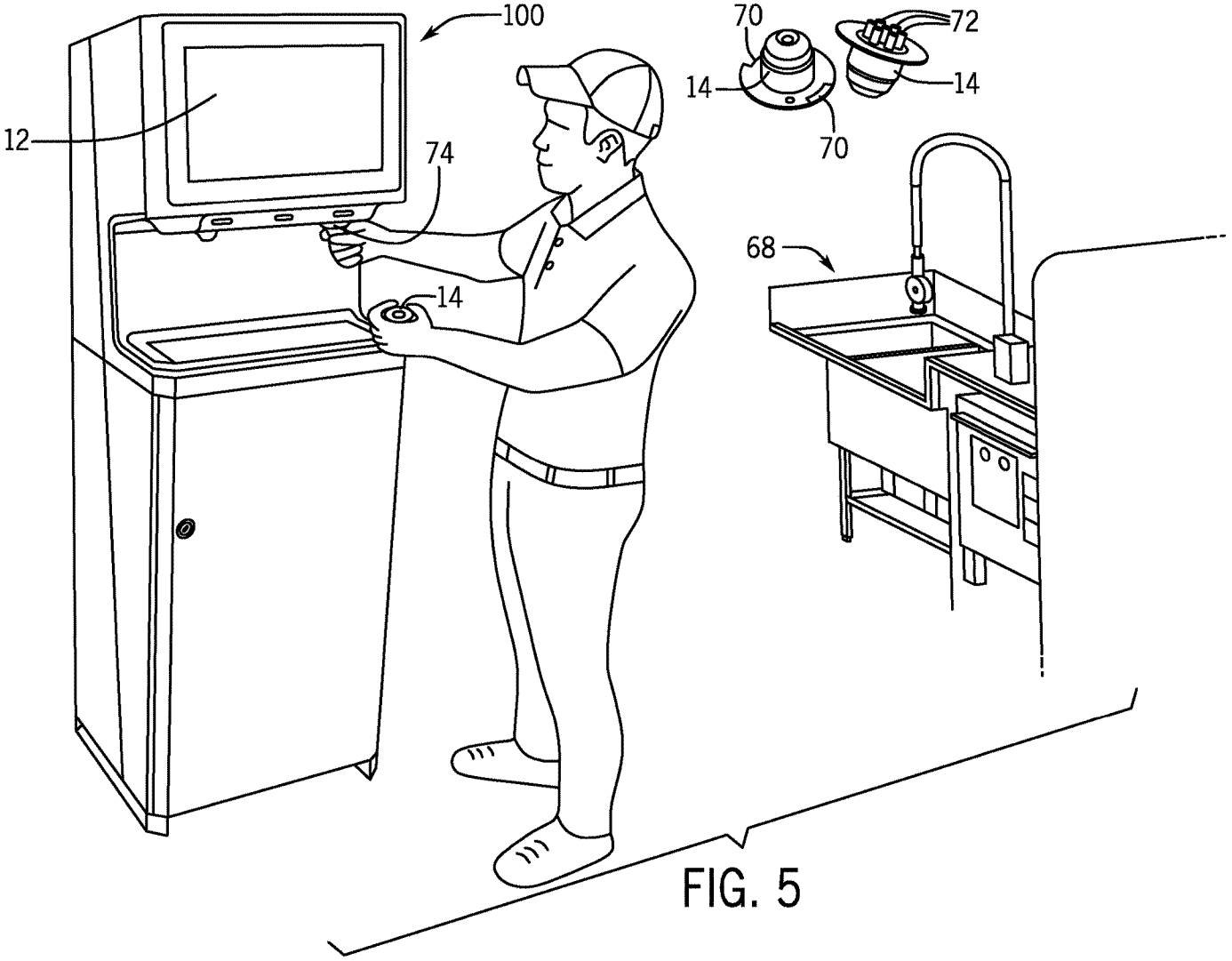
FIG. 5 depicts an exemplary embodiment of a user cleaning nozzles of a dispenser.

FIG. 5 depicts an exemplary embodiment of a user cleaning nozzles 14 of a food dispenser 100. In an exemplary embodiment, the nozzles 14 are removed from the dispenser 100 and exemplarily taken to a sink 68 of a food service location on a daily basis to wash to nozzles 14. The washing of the nozzles 14 on a daily basis rinse the build up of food and/or food residue within the nozzle as the nozzle is most exposed to both and food and air contact.

To facilitate this frequent removal and cleaning of the nozzles 14, the nozzles 14 may include bayonet connections 70 which rotate to lock the nozzle 14 into position in the dispenser 100 while permitting quick detachment. In a further embodiment, inlet barbs 72 may be constructed in a manner such as to engage nozzle fitments, which may include a manifold 77 with inlets for the flexible tubes 45 and at least one outlet to connect to the nozzle 14. An elastomeric interface 74 may be positioned between the outlets of the manifold 77 and the nozzle 14. The elastomeric interface 74 may be a portion of the manifold 77 or may be a separate component therefrom. In this manner, the manifold 77 remains in the dispenser unit, while the nozzle can be removed for manual cleaning without disconnecting the flexible tubes, which can stay connected to the manifold 77. The inlet barbs 72 of the nozzle may engage the manifold 77 through the elastomeric interface 74, which may exemplarily bean elastomeric gasket, in a friction fit. In an exemplary embodiment, the condiments and flavorings as dispensed through the nozzle 14 are dispensed at a relatively low flow rate and dispensing pressure. In an embodiment described above in which the pumps are peristatic pumps, such pumps may provide reliable dispensing yet such dispense may occur at a lower pressure and flow rate. Therefore, a friction fit between inlet barbs and a fitment, including but not limited to, the elastomeric interface 74 and the manifold 77 may provide a sufficient seal for the dispense of the custom condiments at the operational pressure and flow rates while still facilitating ease of removal and reconnection by a user for manual cleaning of the nozzle 14.

Figure 6:
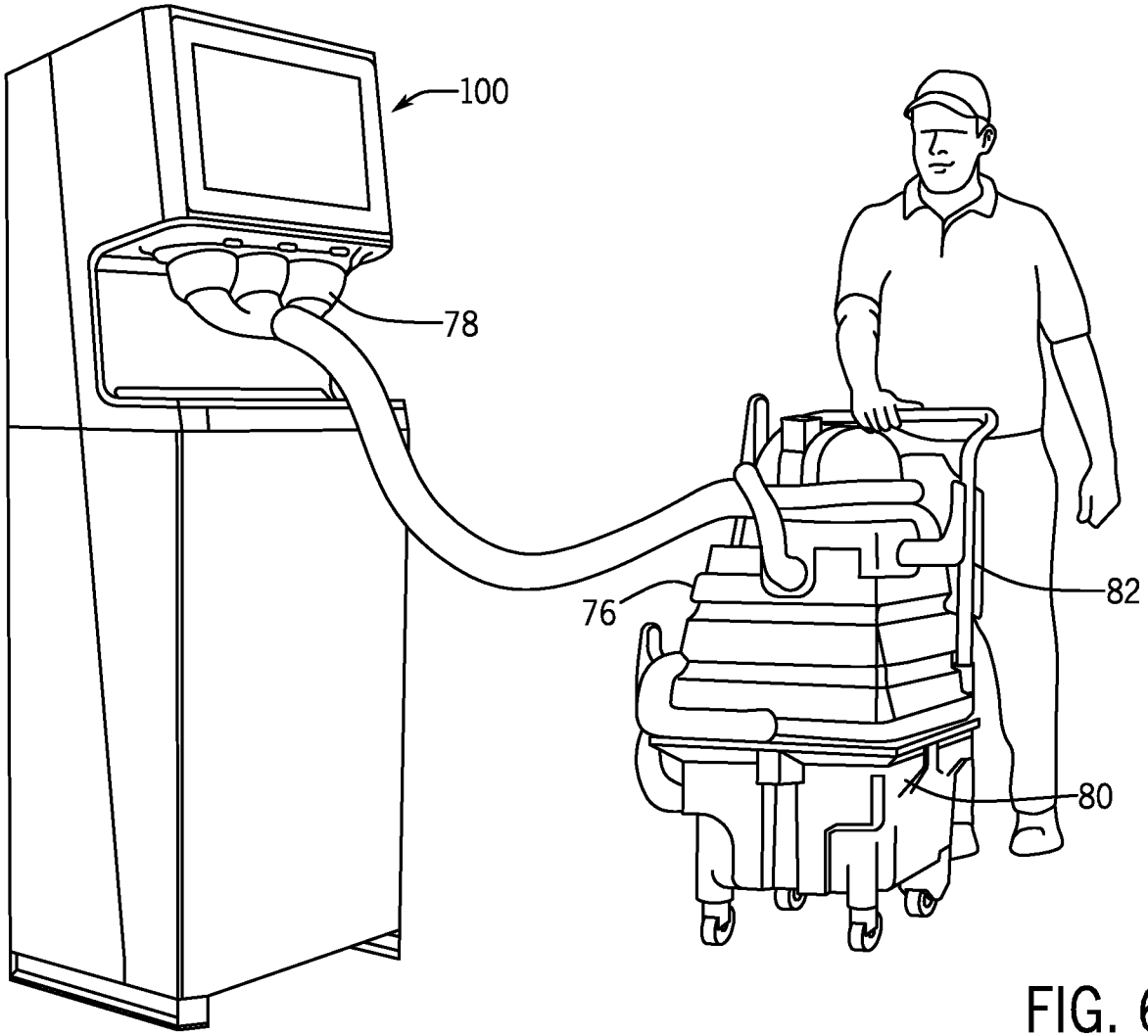
FIG. 6 depicts an exemplary embodiment of a user cleaning an upper plumbing of a good dispenser.

FIG. 6 depicts an exemplary embodiment of a user cleaning an upper plumbing of a dispenser 100. In an exemplary embodiment this cleaning may occur on a weekly basis and as previously described with respect to FIGS. 2 and 3, the upper plumbing 62 includes the flexible tubes 45 between the nozzle 14 and the valves 43. In an exemplary embodiment, this may be performed on a weekly basis to additionally clean the portions of the system in food contact and in which the food has greater potential for air contact (e.g. down stream of the valves 43). In an exemplary embodiment, the nozzles are removed as described above and a cleaning device 76 is fluidly connected either to the nozzles or to the dispenser 100 in the position of the nozzles. In an exemplary embodiment, the elastomeric gasket 74 may be removed and cleaned and the cleaning device 76 may be connected to the condiment dispenser 100 with a cleaning interface 78 that secures to the fitment by which the nozzle is connected to the flexible tubes. The cleaning interface 78 may include a similar number of ports or connection locations as the number of nozzles in the dispenser 100. In this manner, the cleaning interface may comprise a matching suitable number of ports to fluids connect to each of the flexible tubes to which the muzzle (now removed) had connected.

Figure 11B:
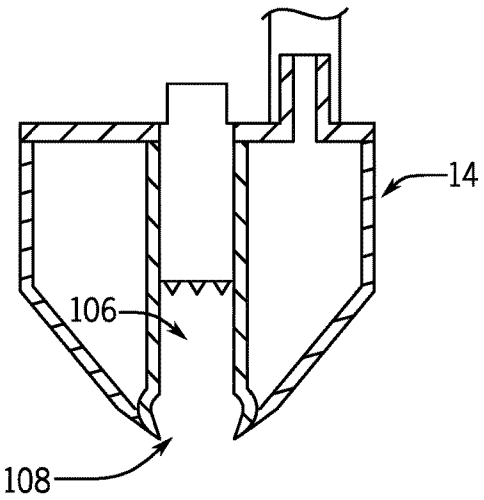
FIGS. 11A-B depict another exemplary embodiment of a system for cleaning a nozzle.
Figure 11A:
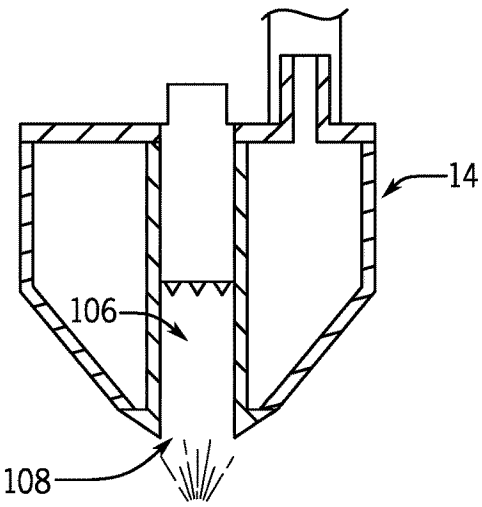
Figure 10:
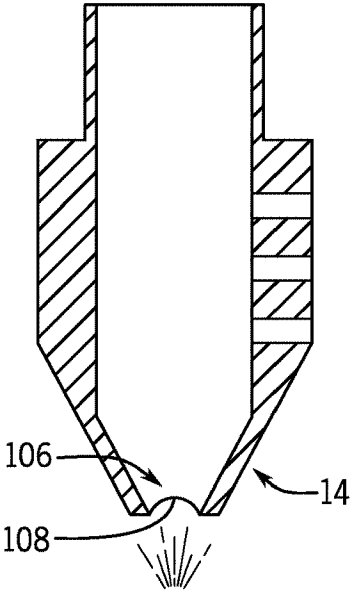
FIG. 10 depicts an exemplary embodiment for cleaning a nozzle.

In certain embodiments of the nozzle 14, the outlets 106 to atmosphere may be sealed, especially by an elastomeric valve 108 as depicted in FIGS. 10 and 11, in order to protect the product from air and prevent skinning. These valves 108 remain closed when no pressure is produced by pumps, and open upon application of fluid pressure. The valves 108 may be a circular diaphragm for certain nozzles as depicted in FIG. 10, or an annular umbrella valve as depicted in FIGS. 11A and 11B. Sanitation requirements may involve cleaning the outer surface of the nozzle 14 as well as any areas of the fluid path exposed to atmosphere.

Figure 12B:
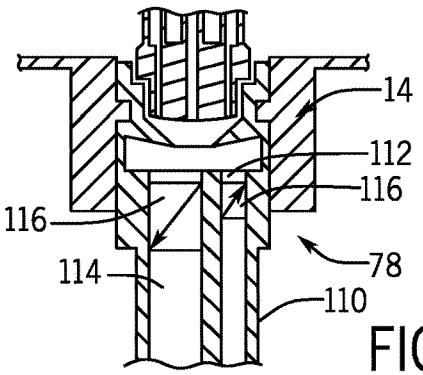
FIGS. 12A-B depict an exemplary embodiment of a system for cleaning a nozzle.
Figure 12A:
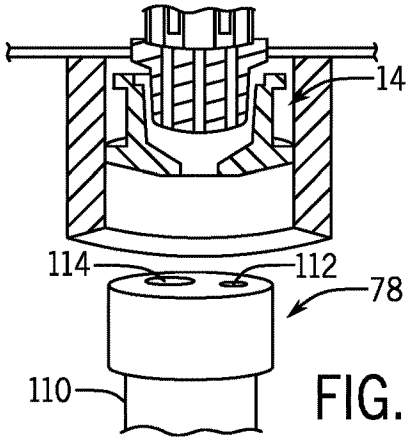

In another embodiment, the nozzle 14 can be cleaned in place because the product is sealed and protected by the elastomeric valves 106. FIGS. 12A and 12B depict an exemplary embodiment of a cleaning interface 78 as described previously that may attach to the nozzle 14 itself in place of the nozzle 14. In addition to allowing cleaning fluid to drain, a hose 110 of the cleaning interface 78 includes an inlet 112 of cleaning fluid pumped from the cleaning system to wash the outside of the nozzle 14 and a drain 114 to draw the cleaning fluid away. Both the drain 114 and cleaning solution inlet tube 112 feature check valves 116 in the direction of fluid flow to prevent contamination of the cleaning solution or backflow from the drain.

Figure 13:
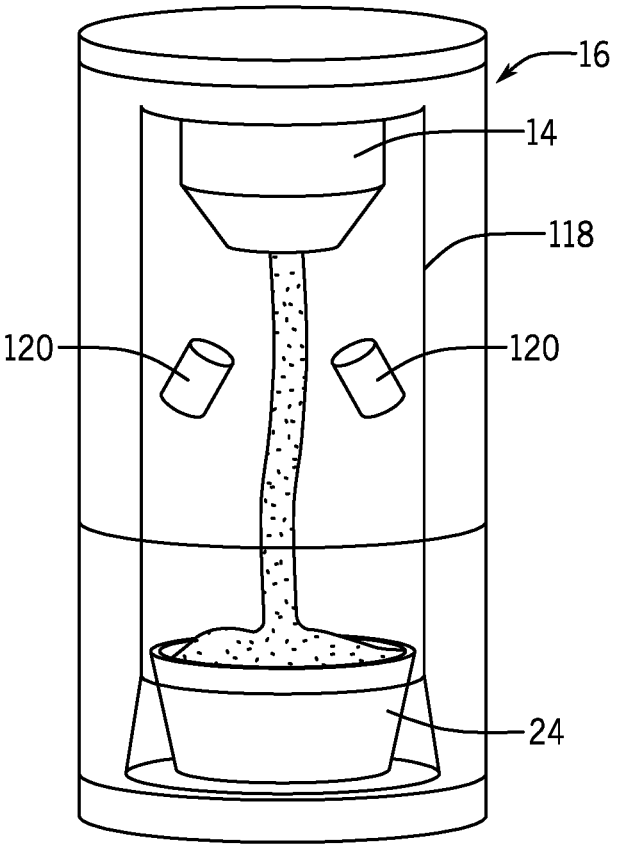
FIG. 13 depicts an exemplary embodiment of a dispensing area with nozzle cleaning.

Cup placement and backsplash geometry is important to reducing spills and unwanted foodstuffs from being introduced into areas to be cleaned. In one embodiment as shown in FIG. 13, the areas below the nozzle 14 are shaped such that only a particular receptacle 24 (e.g. a portion cup) can be placed under the nozzle 14 in the dispensing area 16. This prevents food items like sandwiches being placed directly below the nozzle 14, where ingredients from the sandwich could drop onto the cup rest. In a further embodiment, the dispensing area 16 may be further isolated by a movable door 118 and the dispense may occur only when a portion cup is placed in this isolated chamber. The receptacle may be placed in the dispensing area 16, for example on a cup rest below the nozzle, and a proximity sensor may be used to verify the receptacle 24 is in position. The door 118 may rotate in front of the receptacle 24 to shield during product dispense. This will prevent the user from interrupting the dispense, as well as prevent different food items from being placed in the dispense area. This shield may also be used to create a cleaning chamber to clean the outside of the nozzles 14. After the filled receptacle 24 is removed, the door 118 may close again and jets of cleaning fluid 120 may spray the nozzle 14 and drain into the drip tray. This could occur during a daily cleaning cycle or after individual dispenses.

Drips and spills of product in the product tray may cause odor or be visually unappealing to the user. To manage this in between cleanings by an employee, the cup rest may be shaped with louvers to act as blinds to the drip tray where spills collect. This may also manage odor by blocking how much of the spilled product is exposed to air. In other embodiments, cup rest may be fabricated from or coated in a hydrophobic and/or oleophobic substance that allows drips to quickly migrate towards the drip tray, thus preventing build up.

In an exemplary embodiment as described above, wherein the dispenser 100 includes reservoirs of cleaning solution, for example a detergent reservoir, sanitizer reservoir 54, and rinse reservoir 56, and such cleaning solutions may be used to automatedly perform some of the cleaning functions as described herein, for example, the exemplary weekly cleaning of the upper plumbing, the cleaning device 76 may be used to remove the used cleaning solution from those reservoirs and replace the cleaning solution within the reservoirs 52, 54, 56 with fresh cleaning solution from reservoir(s) of cleaning solution connected to the cleaning device 76.

Figure 7:
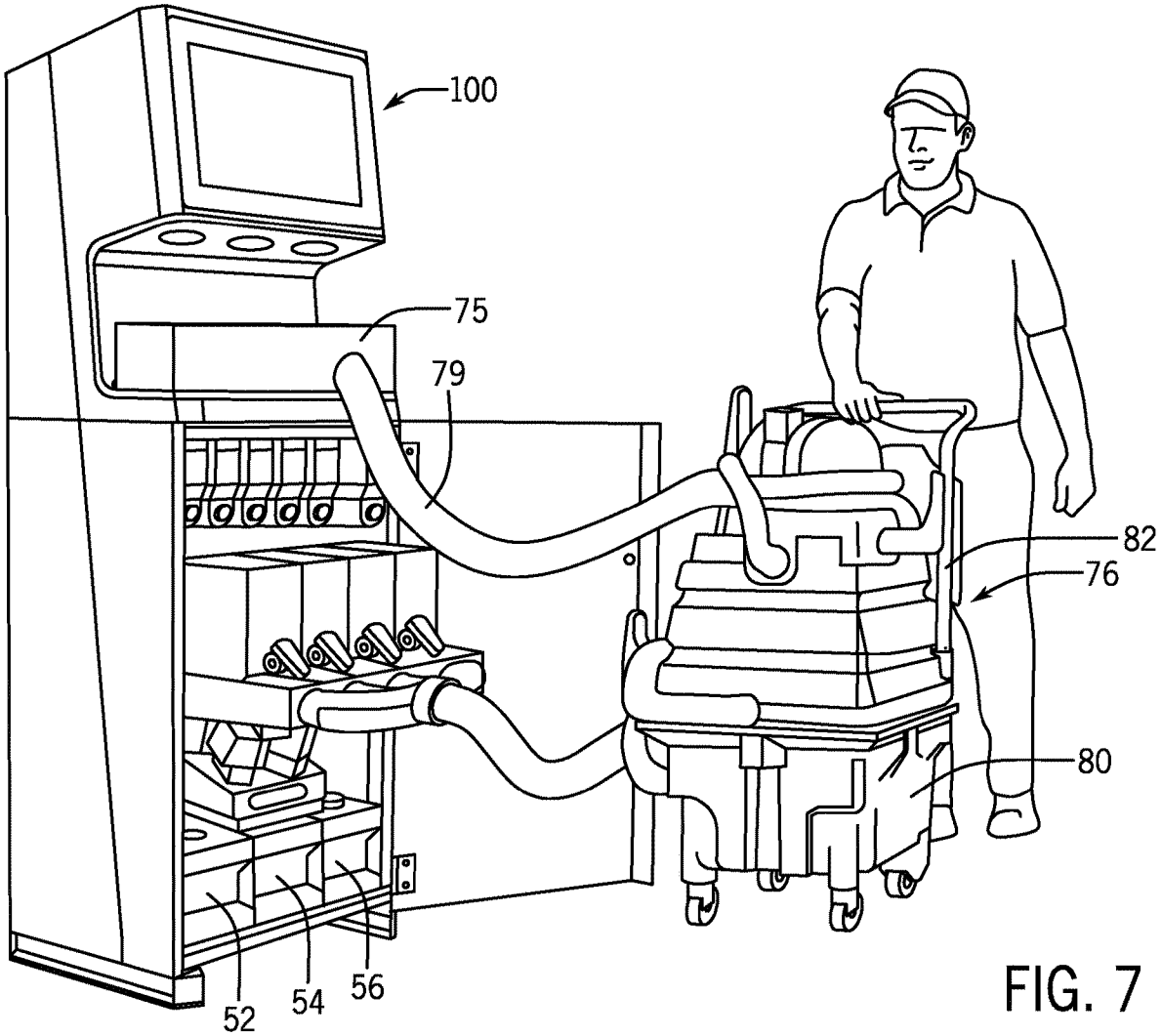
FIG. 7 depicts an exemplary embodiment of a user cleaning an entire dispensing system.

As depicted in FIGS. 6 and 7, the cleaning device 76 includes both reservoir(s) of cleaning solutions 80 as well as a waste tank 82 for collecting the used cleaning solution. The cleaning device 76 may include pumps and valves (not depicted) to carry out a cleaning operation by sequentially pumping the cleaning solutions into the upper plumbing of the condiment dispenser 100 and drawing the cleaning solutions out of the condiment dispenser, disposing of the spent cleaning solution in the receptacle 82.

Figure 14:
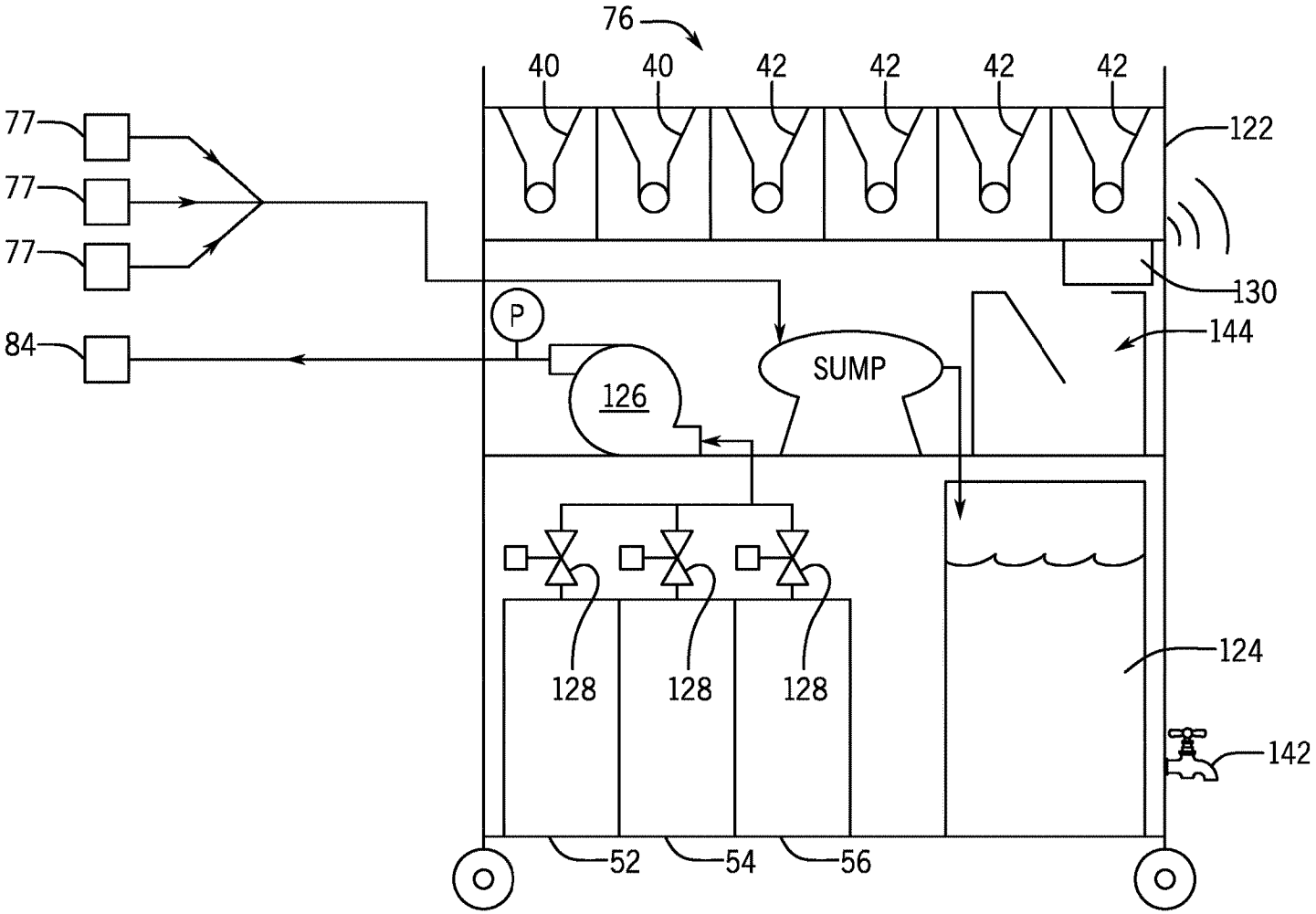
FIG. 14 is a system diagram of an exemplary embodiment of a cleaning device.

FIG. 14 is a system diagram of an exemplary embodiment of the cleaning device 76. The cleaning system 76 may be mostly contained on a mobile cart 122 that acts as a service and cleaning cart. The cart may contain space for product reservoirs 40, 42 so that heavier reservoirs can be rolled from the restaurant storage area to the unit. This will also discourage employees from taking flexible bags of product to the unit and attempting to load them into the bag containers in the unit, which could cause spillage. The cart 122 may contain separate reservoirs for detergent 52, sanitizing 54, and rising solutions 56, as well as a waste tank 124. The waste tank 124 may be removable for disposal of the used cleaning solutions. In another embodiment, the waste tank 124 may include a spigot 142 for draining of the waste tank 124. These reservoirs may have openings to allow for filling with concentrated chemicals and water from a tap or complete, diluted chemicals. These reservoirs may have spigots or taps (not depicted) at the bottoms to allow for easy drainage into a floor drain. The cleaning system 76 may contain a booster pump 126 to provide additional inlet pressure to the peristaltic pumps of the dispensing system. To reduce the number of necessary pumps, normally closed valves 128 may be used at the outlet of each chemical reservoir before the pump inlet. The cart 122 may also contain a shelf or cabinet 144 to hold components of the dispenser that need to be transported to a sink to be hand-washed, for example nozzles and/or nozzle components.

The cleaning system 76 on the cart may further include a processor or controller (not depicted) which may be arranged to operate the cleaning system 76 independently. In another embodiment, the controller of the cleaning system 76 can communicate with the controller of the dispensing unit via communicative connections 130, e.g. Bluetooth, wireless internet, Ethernet connection, or other method. The controller of the dispenser may then control the pumps and valves of the cleaning system 76 through the controller of the cleaning system 76 to run in synch with the components in the dispenser. It will be understood that in other embodiments the reverse may be true, with the cleaning functions being directed from a controller of the cleaning system 76. The cart 122 may also have its own control system and implement RFID readers on chemical reservoirs. Cleaning chemical refill reservoirs may have an RFID identifier. Scanning or detecting of RFID or other forms of identifiers may help to ensure that the respective reservoirs 52, 54, 56 are filled with the proper cleaning solutions.

In one exemplary embodiment, the controller of the dispenser operates to control both the food dispensing functions of the dispenser, but also the cleaning functions. A cleaning cart 122 may include exemplarily the cleaning solution reservoirs 52, 54, 56, and also include the waste tank 124 to collect the used cleaning solutions. The cleaning cart may further include a connection system 90 to deliver the cleaning solutions from the cleaning solution reservoirs to the flexible tubing and drip tray 75 or a dispenser interface 78 to collect the used cleaning solution. In the exemplary embodiment, the pumps and valves may be located in the dispenser and therefore the dispenser controller operates these components to carry out the cleaning functions once the cleaning cart 122 is connected to the dispenser.

In certain embodiments, the cleaning cart 122 may be of lightweight construction and be collapsible or foldable in some manner. This may allow the cart to use less floor footprint, or even to be hung on wall if sufficiently light.

In certain embodiments, the cleaning system may aid in preparing the diluted cleaning solutions. Cleaning chemicals are normally stocked as a concentrate in liquid or powder form and must be diluted with water by the user for safe use. In one embodiment, liquid concentrates may be stored in containers (not depicted) on the cleaning cart 122, and metering pumps (not depicted) associated with each container of concentrate may dose the concentrates into a stream of plain water to create the respective diluted cleaning chemicals. The pumps may also dose concentrates into separate reservoirs already filled with water. In another embodiment, the cleaning chemicals may be cartridges that are placed in line with the cleaning system's water. These cartridges may dissolve as water is run through them to create a diluted solution. In another embodiment, the unit may have a water line built-in, which may be used for cleaning the nozzles as previously described. This water line may be ran from the unit to the cart to fill the solution tanks. In a still further exemplary embodiment, the valves and booster pump of the cleaning system 76 may be inside the dispensed, for example shown in described with respect to FIGS. 2 and 3, in order to reduce necessary space and weight on the cart 122.

In another embodiment of the cleaning system, the cleaning solution reservoirs may be pressurized in order to eliminate the need for a booster pump on the cart. These embodiments may reduce noise of the cleaning system during operation and use. The reservoirs may be opened to be filled with cleaning solution concentrate and may be pressurized with water, thus diluting and completing the solution or with a gas, such as the CO2 supply, for example as may already be used in a restaurant setting, for generating soda water. These containers may be similar to a soda keg available from Cornelius, Inc., which allows for simple refilling and pressurizing, and de-pressurizing. The water may use an existing or newly installed booster pump in the back of house. The waste container may also be pressurized when the cart is returned to the floor drain with a gas to speed drainage of the waste product. The waste product will have phases of highly viscous fluid, and will not readily drain via hydrostatic pressure from gravity. Thus, an increased pressure is desired. The booster pump or sump pump on the cart may also be reconfigured to assist drainage of the waste tank into a floor drain.

Referring back to FIG. 7, FIG. 7 depicts an exemplary embodiment of a user cleaning an entire dispensing system 100. In an exemplary embodiment this may occur on a weekly or monthly basis to clean all portions of the dispenser 100 that come into contact with food. The cleaning device 76 includes a drain tray 75, which is exemplarily an open container, fitted with a drain hose 79 connected back to the waste tank 82 of the cleaning device 76. The cleaning device 76 further connects a dispenser interface 84 to the receptacles 40, 42. For example, the interface 84 may connect to the previously mentioned axillary connections 64 of the reservoirs 40, 42. In an exemplary embodiment, the cleaning device 76 may be first connected to the base condiment reservoirs for cleaning and then connected to the flavoring reservoirs 42. The cleaning device 76 may operate in the manner as described above with respect to FIG. 2 or 3 to flush the system 100 in either or both of directions from the nozzles to the receptacles or from the receptacles to the nozzles. In exemplary embodiments, the pumps 46 and/or valves (not depicted) of the dispenser 100 may be operated in conjunction with the operation of the cleaning device 76 to facilitate the sequential circulation and removal of cleaning solutions through the dispenser 100. In a still further embodiment, as will be described in further detail herein, the reservoirs 40, 42 may be removed for cleaning separately, or in the event of disposable bags, boxes, or bag-in-box containers of base condiment or flavoring, the reservoirs may be removed entirely and disposed of while the interface 84 fluidly connects to the dispenser 100.

Figure 8:
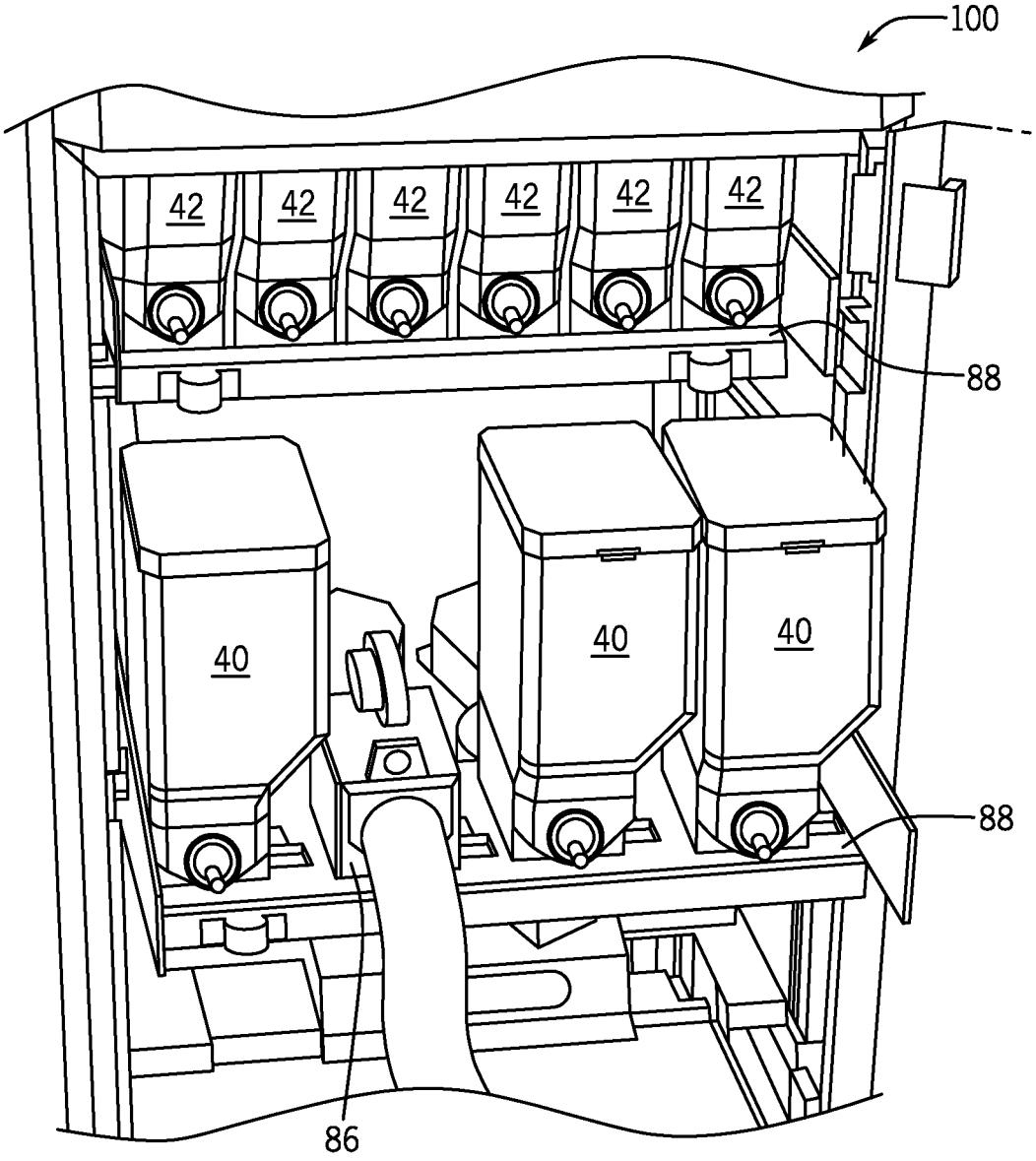
FIG. 8 depicts an exemplary embodiment of cleaning a single line of a dispensing system.

FIG. 8 depicts an exemplary embodiment of cleaning a single line of a dispenser, for example with the cleaning device 76 as described above with respect to FIGS. 6 and 7. As depicted in FIG. 8, an individual reservoir may be removed from the dispenser 100. For example, this may be due to changing a flavor or condiment type within the dispenser 100. An individual interface 86 connected to the cleaning device 76 may secure an interface to the flexible tube 45 associated with the removed reservoir. Similar connection to one or more of the nozzles (not depicted) may enable flushing of the dispenser 100 at any component which previously came in contact with the substance of the removed reservoir. In exemplary embodiments, the dispenser 100 may place the reservoirs 40, 42 on a moveable rack 88. These moveable racks may exemplarily slide and/or roll on bearings or wheels to conveniently give a user access to reservoirs and/or to the flexible tubes and/or pumps within the dispenser 100.

In another embodiment of the cleaning device 76, instead of individually connecting a drain hose 78 to each nozzle 14, a tray (not depicted) may be placed below the nozzles, with a single drainage hose leading to a drainage tank or sump pump of the cleaning device 76.

Figure 9A:
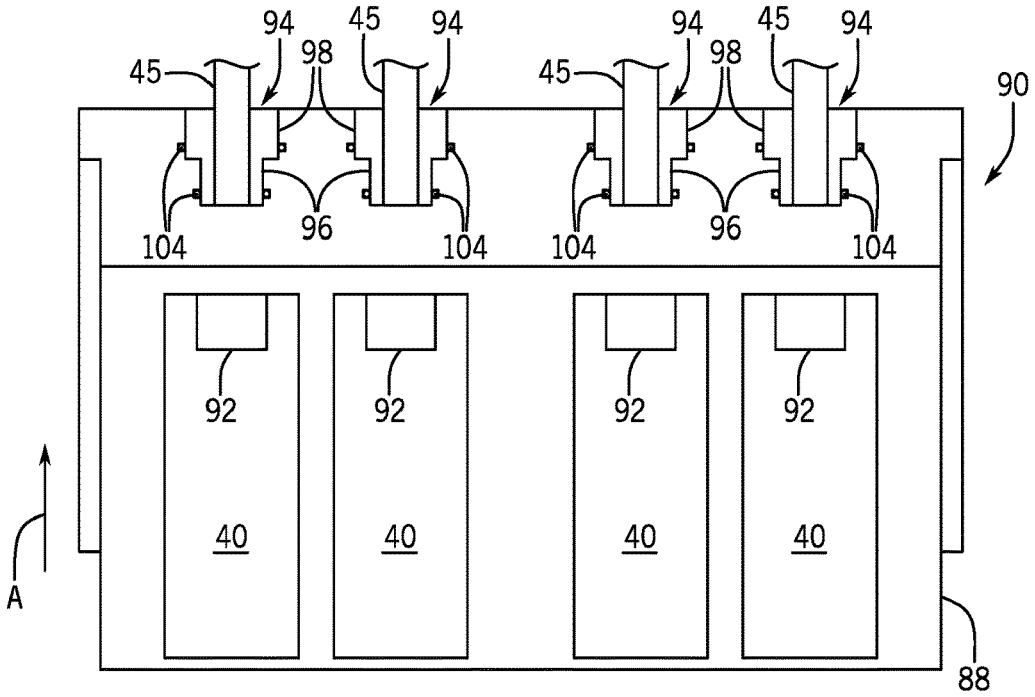
FIGS. 9A and 9B depict an exemplary embodiment of a connection system as may be used to connect reservoir or a cleaning device to a dispenser.
Figure 9B:
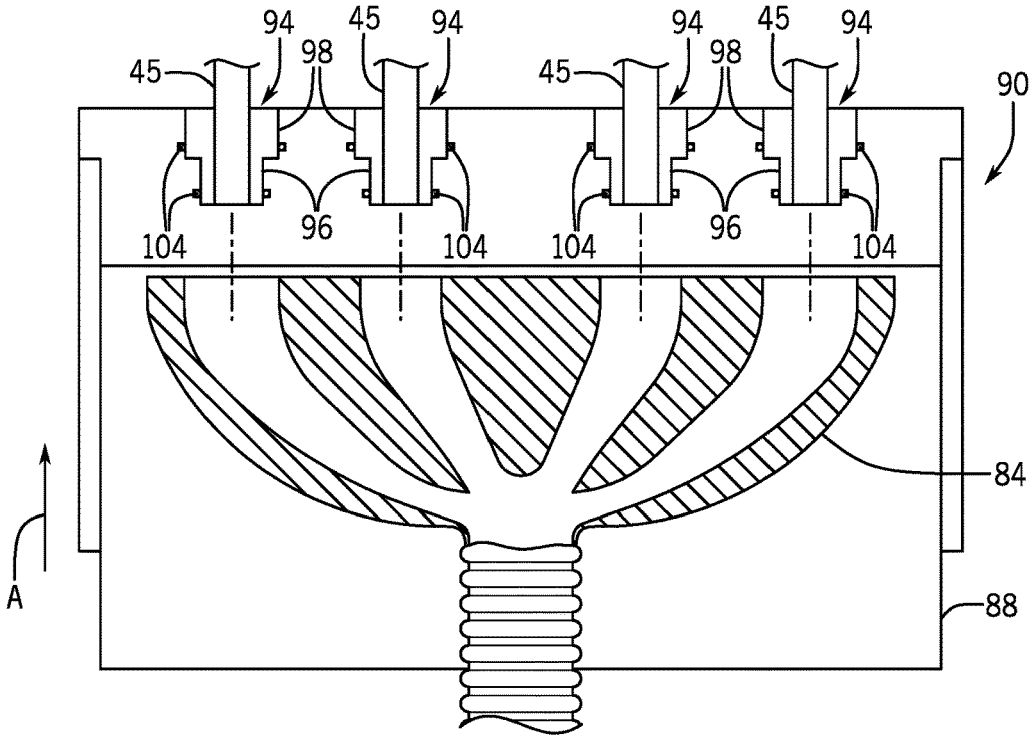

It is possible that outlets of the cleaning device may be attached to the inlets of the condiment reservoirs 40 and/or the flavoring reservoirs 42 only during cleaning cycles. In embodiments, the cleaning inlets are permanently plumbed into or at product inlets. FIGS. 9A and 9B depict an exemplary embodiment where there is a single interface for the cleaning system into the unit (either single or multiple line) that tees into each product inlet. Cleaning occurs when the product reservoirs are disengaged from the product inlets in order to protect the product from cleaning solutions. It is possible that the reservoirs are sufficiently protected that they do not be disengaged during the line cleaning process. In a further exemplary embodiment, a check valve on the product inlet and cleaning inlets prevent backflow of used cleaning solution into either. It is possible that the cleaning inlets may be removable. FIGS. 9A and 9B depict an embodiment where the products are disengaged from the product inlet, and a series of cleaning inlets are placed onto the product inlets. The cleaning inlets exemplarily have check valves to prevent backflow of food product, or used cleaning solution into the cleaning system. The product inlet valves have check valves to prevent product spillage during the change out.

An exemplary embodiment of a connection system 90 may be used to connect the cleaning device 76 to the reservoirs 40, 42 and/or to connect the cleaning device 76 to dispenser 100. As previously described above, the dispenser 100 may include a movable rack 88 upon which the reservoirs 40 may be positioned. In an exemplary embodiment, the reservoir 40 includes a connection interface 92 which exemplarily is a portion of the reservoir configured to receive a connection shank 94 of the dispenser which exemplarily includes the start of the flexible tube 45. The connection shank 94 is configured to engage the reservoir 40 through the connection interface 92. In one embodiment, the connection shank 94 may engage the connection interface 92 in a friction fit. In another embodiment, particularly if the reservoir 40 is a disposable or single user reservoir, the connection interface 92 may be a burst valve or a portion of the reservoir configured to be punctured by the connection shank 94. Movement of the tray 88 in the direction of arrow A moves the rack 88 from an extended position which facilitates loading of the reservoir 40 onto the rack 88 and a second inserted position in which the connection shanks 94 engage the connection interfaces 92 of the reservoirs to fluidly connect the flexible tubes 45 to the interiors of the respective reservoirs 40.

Referring now to FIG. 9B, the connection system 90 further facilitates the connection of the cleaning device 76 to the dispenser 100. As previously described above, an interface 84 from the cleaning device fluidly connects to the dispenser. In an exemplary embodiment, the tray 88 is pulled out and the reservoir 40 removed for cleaning or disposal and the interface 84 is secured to the tray 88 moving the tray 88 in the direction of arrow, engages each of the connection shanks 94 with the interface 84 to fluidly connect the cleaning device to the flexible tube 45 of the dispenser.

In exemplary embodiments, the connection shank 94 includes an interior surface 96 and an exterior surface 98. The interior surfaces 96 are exemplarily configured to engage the connection interface 92 of the reservoirs 40 while the exterior surfaces 98 of the connection shank 94 engage the connection surfaces 102 of the interface 84. In this manner, the interior surfaces 96 which may come into food contact when inserted into the reservoir 40 may be cleaned during the cleaning processes out by the cleaning device 76. In an exemplary embodiment, connection shanks 94 may further include one or more O-rings 104 or other seals to facilitate a fluid connection and seal respectively with the reservoirs 40 and/or the interface 84.

Figure 15:
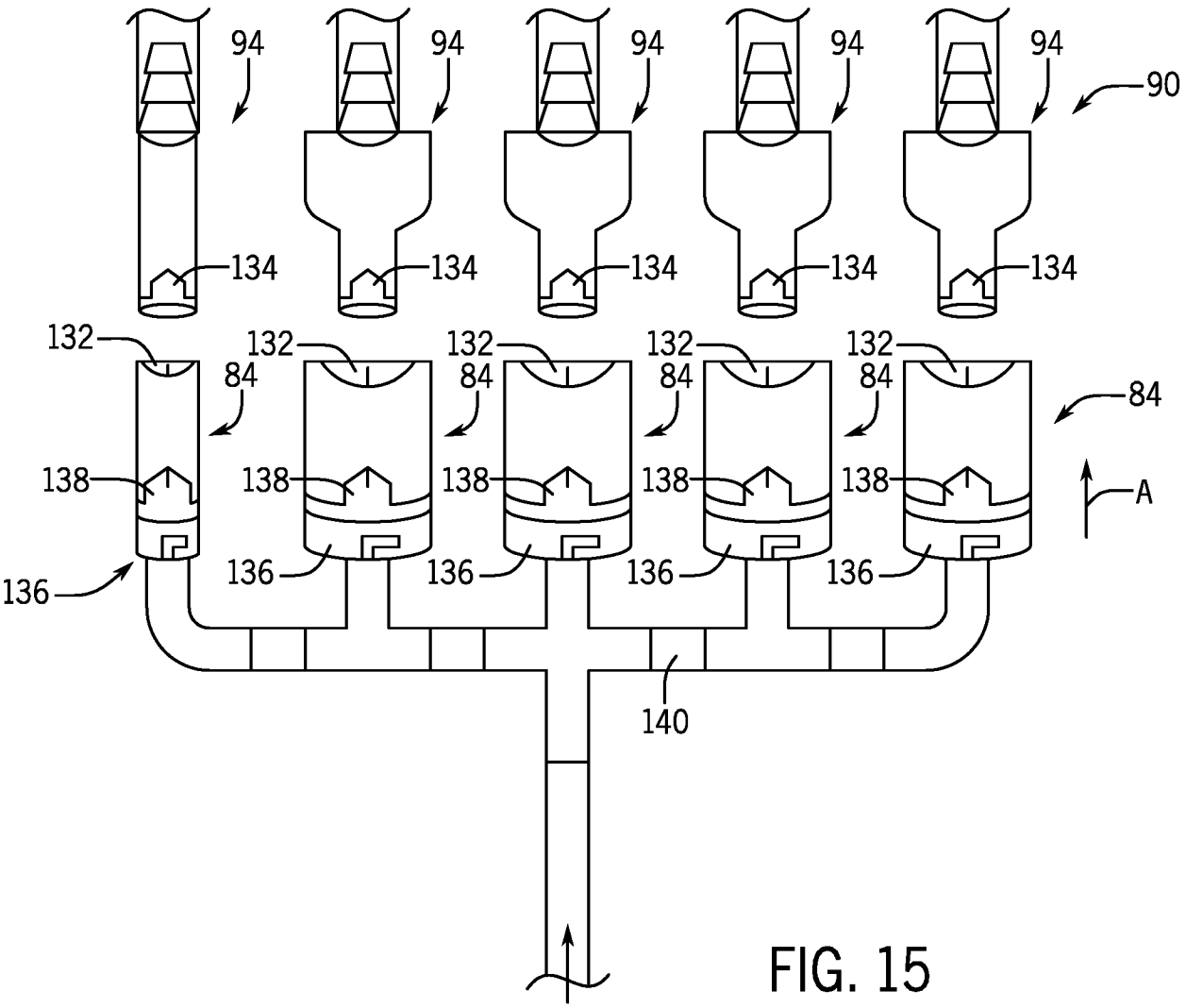
FIG. 15 depicts an exemplary embodiment of a connection system between a cleaning device and a dispenser.

In still further embodiments, the cleaning interfaces as described with respect to FIGS. 9A and 9B may take several forms, such as a series of branches that can inserted into the unit as a set simultaneously, or as individual hoses or heads to be attached individually. In an embodiment where the cleaning inlets are individual interfaces as shown in FIG. 8 or a unity assembly of interfaces 84 as shown in FIG. 9B, the cleaning heads may be female and the unit product inlets 94 male. This is further exemplarily shown in FIG. 15. In FIG. 15, the interface 84 of the connection system may include seals 132 which may be elastomeric seals or some other catheter type seal that slides on to the connection shanks 94 with a friction fit, though this may also be an o-ring fit. O-rings exemplarily shown in FIGS. 9A and 9B may be less desirable in these cleaning applications because they retain fluid, potentially unsanitary, in their grooves. The connection shanks 94 may rather feature an additional check valve 134, which could be an elastomeric duckbill or cross slit valve to prevent backflow from the machine into the cleaning device, as well as dripping before the connection system 90 is in place and fluid is flowing since the valve 134 will have a minimum cracking pressure. It is possible that the interfaces 84 themselves are separable (such as via twist lock 136) so that the interfaces 84 can be hand sanitized in the event that food from the connection shanks 94 contaminates them. Internal to the separable interfaces 84 may be a flexible check valve 138 to further limit spillage of cleaning solution or waste water during connection/disconnection of the interfaces 84. The connection system 90 may be further constructed of tubing 140, that is flexible so that the interfaces 84 may be placed individually, or tubing 140 that is rigid so the entire assembly can be slid on at once. In the event that the tubing 140 is rigid, there may be a guiding track or other cam lock system to help the user guide the connection system 90 to the connection shanks 92, since they may be difficult to access without completely removing product reservoirs.

FIG. 16 depicts an exemplary embodiment of a three way valve 47. The valve 47 is depicted as a passive valve in that it operates with one or more check valves to control the flow of substances through the valve. It will be recognized that other embodiments of valves may be used within the systems of the present disclosure, including, but not limited to electronic or electro-mechanical valves. The valve 47 includes a product inlet 146 and a cleaning solution inlet 148. The valve 47 directs the product or cleaning solution through an outlet 148. The outlet 148 is exemplarily connected to the flexible tubing 45 that is directed to the pump(s) and/or nozzle(s) (not depicted). The product inlet 146 is configured to fluidly connect to a respective product reservoir. Thus the product inlet 146 may be a male or female connection compatible with a corresponding connection to the reservoir. In FIG. 16, the product inlet 146 is a male connection and may exemplarily engage an elastomeric burst valve style connection 150 with the reservoir. In another embodiment, the product inlet may exemplarily be a female connector where the actual inlet is a catheter-type seal that serves as check valve to prevent dripping when product is disengaged. This may also serve as backflow prevention during cleaning cycles if such check valve has a sufficiently high cracking pressure.

Regardless of fit, the interface between the product inlet 146 and the connection 150 may further include a check valve to ensure that the product does not drip or leak into the dispenser cabinet.

The product inlet 146 is protected by a check valve 152 to The valve 47 includes check valves that prevent dripping as well as backflow of cleaning solution during cleaning cycles. The cleaning solution inlet 148 tee's in after the product inlet check valve 152. The cleaning solution inlet 148 may also be protected by a check valve 154. The check valves 152, 154 help to ensure that the product and the cleaning solution are directed through the valve 47 into the flexible tube 45 without cross contamination of the respective reservoirs of product and cleaning solution. To avoid particulate settling near grooves of the cleaning solution check valve 154, the cleaning solution inlet 148 may tee into the valve 47 from above as shown in FIG. 16, The cleaning solution inlet 148 may further come into the valve 47 from an angle in order to effectively clean the surface of the product inlet check valve 152 In addition to the check valves depicted in FIG. 16, the check valves used in the systems as disclosed herein may take many forms, such as traditional ball check valves. In embodiments, the check valves may be elastomeric valves like duck bill, umbrella, slitted diaphragm, or cross-slit duck bill check valves, such as those developed and available from Mini Valve, Vernay, or LMS. These valves contain simple surfaces less likely to retain particulate, and can often serve another duty as catheter seals for any shank connections.

Figure 17:
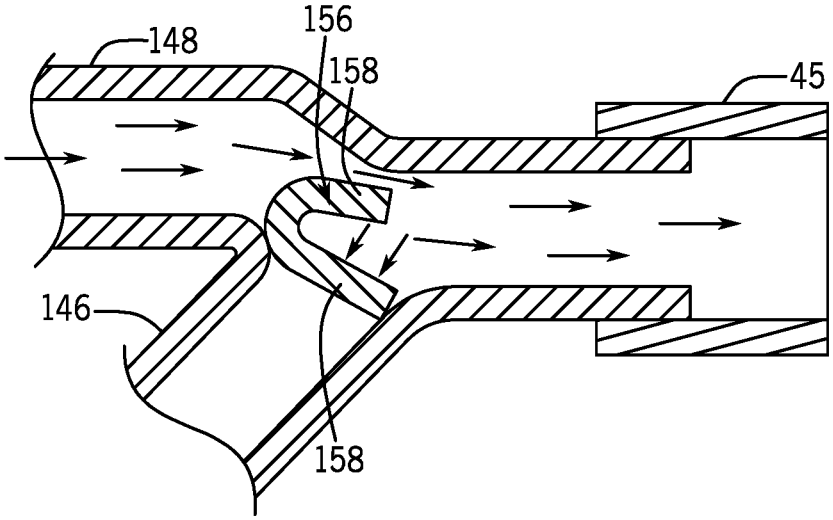
FIG. 17 depicts a further exemplary embodiment of a three-way valve as may be used in embodiments of a dispenser cleaning system.

In another exemplary embodiment as shown in FIG. 17, a butterfly shaped diaphragm 156 may be positioned at the junction between the product inlet 146 and the cleaning solution inlet 148. The diaphragm 156 is exemplarily secured at its middle between the product inlet 146 and the cleaning solution inlet 148 with the flaps 158 of the diaphragm 156 respectively covering each inlet perpendicular to direction of flow through that inlet. When pressure is applied in one of the product inlet 146 and the cleaning solution inlet 148 in the desired flow direction, the flap 158 associated with the inlet in which the pressure is applied opens to permit fluid flow to the flexible tube at the outlet; however that fluid flow provides a back pressure on the other flap 158 that keeps the that flap 158 closed across the other inlet.

In still further embodiments, the unit product inlets may need to be removable on certain interval cleaning cycles longer than line flushes. In such embodiments, the valve may include an additional check valve that remains in place after the connection is removed to prevent dripping. In such an embodiment, the product inlet and the cleaning solution inlet may be respectively connected via a cam lock bayonet.

In further embodiments, a single interface between the dispenser and the cleaning system may be desirable to promote ease of use. Permanently tee-ing in cleaning solution inlets may limit cleaning of the entrance of the fitting. In order to clean the fitting entirely without the user manually placing on a cleaning branch, the cleaning solution may need to enter via a concentric collar that surrounds the entire product inlet, which enables cleaning of all portions of the fitting. A cleaning collar exemplarily surrounds the a shank of the product inlet, sealed by an elastomeric catheter seal or o-ring connection. The collar may be spring loaded and may slide along the product inlet shank. When the product reservoir is in place, the reservoir, a portion of the reservoir, or another structure associated with the reservoir pushes the collar back and exposes the product shank, as well as compresses the spring on the collar. When the product reservoir is disengaged, the spring-loaded collar slides forward and covers the shank, wiping excess product off the shank. When the cleaning system is engaged, cleaning solution enters the collar and further cleans the shank, and then enters the check valve on the shank itself and cleans the rest of the product line. The elastomer seal on the collar has a sufficiently high cracking pressure to prevent the cleaning solution from flowing through. As previously described, a check valve protects the cleaning line as well.

While such solutions may be less complex to implement with a male product inlet shank, it will be recognized from the present disclosure that such an embodiment may alternatively be implemented with a female product inlet. Exemplarily, when the product reservoir is in place, a shank friction fits with both the cleaning collar seal and the product inlet seal. When the product reservoir is removed, the cleaning solution may reach every surface food has touched. In a still further example, the product reservoir outlet may be male externally and female internally, and the unit inlet may be female externally and male externally.

There may be various measures to help retain the product and/or cleaning solution reservoirs in place to prevent spillage as well as provide audible or visual feedback to the user that the reservoirs are in place. In exemplary embodiments, the reservoirs may include a spring clip behaving similar to a snap fit. When pushed in place, the snap fit locks into a shelf or structure configured to support the reservoir. When ready to remove the reservoir, the user can easily disengage the spring clip by bending it backwards. In other instances it may be required that a controller of the dispenser and/or cleaning system carry out, monitor, or otherwise control the ejection and loading of reservoirs. In such embodiments, an electrical, mechanical, or electromechanical sensor may be used to identify if a reservoir is connected, or if the reservoir is the correct reservoir. This determination may be based upon an identification encoded either electrically, mechanically or otherwise on the reservoir itself. In an exemplary embodiment, the controller may use this to first determine if the appropriate reservoir is in place before allowing connection and further to prevent or lock loading or removal of a reservoir if the controller determines that a cleaning cycle is required or ongoing, or a product dispense is occurring. In an exemplary embodiment, a pull solenoid retains the reservoir in place, and the reservoir is sprung loaded. When the dispenser and/or cleaning system is ready to eject the reservoir or enable removal of the reservoir, the solenoid retracts and the reservoir is pushed backwards, disengaging the reservoir from a respective inlet.

In still further exemplary embodiments, components of the fluid path for either product or cleaning solution, including but not limited to reservoir connections, cleaning outlets, and unit inlets may be configured to enable the controller to determine or otherwise identify component connections. In an exemplary embodiment, the controller may be configured with the components to read information from the components or to sense presence or connection of components. In an exemplary embodiment, an electromagnetic switch helps guide and lock the two components in place, as well as provide feedback to the controller indicating that a reservoir or line is in place. In a more intelligent application, the unit is equipped with RFID readers, potentially including write capability, and the reservoirs and interfaces contain information tags. These tags may include information about the product type, expiration date, or if it is a cleaning connection. The unit may lockout dispense of the product if past expiration date, or sense if the wrong product or cleaning solution is in place and may lockout dispense or cleaning operations or prevent engagement of the reservoir as previously described. If a flavor change out is desired, the unit may lockout dispense until the proper cleaning procedure or parts replacement protocol is performed. The unit may then exemplarily write onto the product tag that the package has been opened once placed, preventing an operator from removing and refilling with another product. In the case of cleaning, the unit may sense whether or not the proper interfaces are all in place before engaging the cleaning protocol.

In a still further embodiment, some or all of the components in the dispenser which are in food contact are exemplarily disposable, or disposable after a predetermined number of cleanings. Depending upon a combination of cleaned or disposable components, the cleaning operations as described herein may be adjusted to clean particular portions of the dispensing system.

In the above description, certain terms have been used for brevity, clarity, and understanding. No unnecessary limitations are to be inferred therefrom beyond the requirement of the prior art because such terms are used for descriptive purposes and are intended to be broadly construed. The different systems and method steps described herein may be used alone or in combination with other systems and methods. It is to be expected that various equivalents, alternatives and modifications are possible within the scope of the appended claims.

The functional block diagrams, operational sequences, and flow diagrams provided in the Figures are representative of exemplary architectures, environments, and methodologies for performing novel aspects of the disclosure. While, for purposes of simplicity of explanation, the methodologies included herein may be in the form of a functional diagram, operational sequence, or flow diagram, and may be described as a series of acts, it is to be understood and appreciated that the methodologies are not limited by the order of acts, as some acts may, in accordance therewith, occur in a different order and/or concurrently with other acts from that shown and described herein. For example, those skilled in the art will understand and appreciate that a methodology can alternatively be represented as a series of interrelated states or events, such as in a state diagram. Moreover, not all acts illustrated in a methodology may be required for a novel implementation.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A cleaning system for a food substance dispenser, the system comprising:

a first cleaning solution reservoir configured to contain a first cleaning solution;

a second cleaning solution reservoir configured to contain a second cleaning solution;

at least one pump fluidly connected to the first and second cleaning solution reservoirs;

at least one interface configured to fluidly connect the at least one pump to a flexible tube of the dispenser; and a controller communicatively connected to the at least one pump, wherein the controller operates the at least one pump to selectively circulate the first cleaning solution from the first cleaning solution reservoir through the flexible tubing of the dispenser and then selectively circulate the second cleaning solution from the second reservoir through the flexible tubing of the dispenser.

2. The cleaning system of claim 1, wherein the dispenser comprises a plurality of dispenser reservoirs, and the controller operates the at least one pump to circulate the cleaning solutions into the dispenser reservoirs.

3. The cleaning system of claim 1, wherein at least a portion of the cleaning system is integral with the dispenser.

4. The cleaning system of claim 3, wherein the at least one pump is a dispenser pump that engages the flexible tube, the flexible tube is fluidly connected to a dispenser reservoir configured to contain a dispensed food substance, and the dispenser pump operates to move the dispensed food substance from the dispenser reservoir through the flexible tube to a nozzle.

5. The cleaning system of claim 4, controller is a dispenser controller, wherein the controller is communicatively connected to the at least one pump and operates the at least one pump in a dispensing operation and operates the at least one pump in a cleaning operation to circulate the cleaning solution from the reservoirs through the dispenser.

6. The cleaning system of claim 5, wherein the dispenser comprises a manifold that secures the nozzle to the flexible tube.

7. The cleaning system of claim 1, wherein the controller operates the at least one pump in successive forward and reverse pumping cycles to agitate a flow of the cleaning solution in the flexible tube.

8. The cleaning system of claim 1, wherein the controller controls at least one valve on the flexible tube to selectively open and close while operating the at least one pump to build and release pressure of cleaning solution within the flexible tube.

9. The cleaning system of claim 1, wherein the cleaning system is a device separate from the dispenser, and the cleaning system comprises a cleaning interface configured to releasably and fluidly connect to the dispenser.

10. The cleaning system of claim 9 wherein the cleaning interface is configured to releasably and fluidly connect to the dispenser at a reservoir interface, and the controller operates the at least one pump to circulate the cleaning solutions through the dispenser from the cleaning interface.

11. The cleaning system of claim 10, further comprising a drain tray positioned below the nozzle interface to collect used cleaning solutions.

12. The cleaning system of claim 11 wherein the cleaning system comprises a sump and after the cleaning solutions are circulated through the dispenser, the cleaning solutions are collected in the sump through the drain tray.

13. The cleaning system of claim 9, wherein the dispenser comprises a dispenser controller, a plurality of dispenser pumps, and a plurality of dispenser valves and the controller of the cleaning system communicatively connects with the dispenser controller to coordinate operation of the at least one pump of the cleaning system with the operation of the plurality of dispenser pumps and plurality of dispenser valves to perform a cleaning operation wherein cleaning solution is circulated through the dispenser.

14. A self-cleaning food substance dispenser, comprising:

at least one dispense reservoir configured to hold a food substance;

at least one nozzle configured to dispense the food substance;

at least one flexible tube fluidly connecting the at least one dispenser reservoir to the at least one nozzle;

a first cleaning solution reservoir fluidly connected to the at least one flexible tube, the first cleaning solution reservoir configured to contain a first cleaning solution;

a second cleaning solution reservoir fluidly connected to the at least one flexible tube, the second cleaning solution reservoir configured to contain a second cleaning solution;

at least one pump arranged to create a pressure within the flexible tube; and a controller communicatively connected to the at least one pump, the controller provides operational instructions to the at least one pump to dispense the food substance from the at least one dispense reservoir and to selectively circulate the first cleaning solution from the first cleaning solution reservoir through the at least one flexible tube, and then selectively circulate the second cleaning solution from the second cleaning solution reservoir through the at least one flexible tube.

15. The self-cleaning food substance dispenser of claim 14, wherein the food substance is a condiment.

16. The self-cleaning food substance dispenser of claim 14, comprising at least one valve operably connected to the controller and operated by the controller to selectively connect the flexible tube to fluid flow from the at least one dispense reservoir and the cleaning solution reservoirs.

17. The self-cleaning food substance dispenser of claim 16, wherein the at least one pump is at least one dispenser pump and further comprising at least one cleaning solution pump fluidly connected between the at least one valve and the first or second cleaning solution reservoirs.

18. The self-cleaning food substance dispenser of claim 14, wherein the controller operates the at least one pump to agitate the cleaning solution within the at least one flexible tube while the cleaning solution is circulated within the flexible tube.

19. The self-cleaning food substance dispenser of claim 14, further comprising a user interface operable by the controller, and the user interface is operable to receive cleaning instructions, wherein the controller operates the at least one pump according to the received cleaning instructions.

20. A cleaning system for a food substance dispenser, the system comprising:

a first cleaning solution reservoir configured to contain a first cleaning solution;

a second cleaning solution reservoir configured to contain a second cleaning solution;

at least one pump of the dispenser fluidly connected to the first and second cleaning solution reservoirs;

at least one interface configured to fluidly connect the at least one pump to a flexible tube of the dispenser, the flexible tube fluidly connected to a dispenser reservoir configured to contain a dispensed food substance, and the pump operates to move the dispensed food substance from the dispenser reservoir through the flexible tube to a nozzle;

a controller of the dispenser communicatively connected to the at least one pump, wherein the controller is communicatively connected to the at least one pump and operates the at least one pump in a dispensing operation and operates the at least one pump in a cleaning operation to selectively circulate the first cleaning solution from the first cleaning solution reservoir through the flexible tubing of the dispenser and then selectively circulate the second cleaning solution from the second reservoir through the flexible tubing of the dispenser; and a user interface of the dispenser and operable by the controller, wherein the user interface is operable to receive cleaning instructions, wherein the user interface comprises a bar code scanner, and the cleaning instructions are embodied in a bar code, and wherein the dispenser controller operates the at least one pump according to the received cleaning instructions.

* * * * *